United States Patent [19]

Nakai

[11] 3,952,633

[45] Apr. 27, 1976

[54] DEVICE FOR INSERTING PARTITION LATTICE IN CARTON

[76] Inventor: Hidekazu Nakai, No. 34-9, 1-chome, Kami-Ikebukuro, Toshima, Tokyo, Japan

[22] Filed: Apr. 10, 1974

[21] Appl. No.: 459,855

[30] Foreign Application Priority Data

Apr. 16, 1973 Japan ..... 48-44561

[52] U.S. Cl. ..... 93/37 R; 93/36.01; 93/53 SD

[51] Int. Cl.[2] ..... B31D 3/04; B31B 11/02

[58] Field of Search ..... 93/37 R, 37 EC, 37 SP, 93/53 SD, 53 R, 36 R, 36.01; 53/185, 48

[56] References Cited

UNITED STATES PATENTS

| | | | |
|---|---|---|---|
| 3,386,224 | 6/1968 | Shuttleworth | 53/381 R X |
| 3,621,765 | 11/1971 | Sootheran et al. | 93/37 R |
| 3,848,519 | 11/1974 | Ganz | 93/53 SD |

*Primary Examiner*—James F. Coan

*Attorney, Agent, or Firm*—Wenderoth, Lind & Ponack

[57] ABSTRACT

An apparatus for inserting into a hollow carton a partition lattice which is assembled from slitted longitudinal partition panels and slitted transverse partition panels by placing the slitted portions of the partition panels over one another to produce a lattice-like assembly of partitions. The apparatus has a feeder for feeding folded partition lattices over-lapping one on the other in a vertical state onto a table, towards the front end of said table, a device for opening the folded partition lattices, a lifting means at the front of the opening device for lifting the opened partition lattice as the lifting means rises, a transfer means for transferring the lifted partition lattice to a position right above a hollow carton waiting to receive the partitions, a means for inserting the partition lattice into the carton and for releasing the partition lattice from the transfer means.

2 Claims, 25 Drawing Figures

DEVICE FOR INSERTING PARTITION LATTICE IN CARTON

The present invention relates to an apparatus for inserting a partition lattice into a carton.

It is known that a partition lattice made from paper board such as corrugated paper can be fabricated as follows: longitudinal partition panels are provided at equal intervals with vertical slits extending upward from the lower end thereof to the middle; transverse partition panels are provided with similar downward slits at equal spaces from the upper end thereof; required numbers of said longitudinal and transverse partition panels are assembled into a lattice by inserting corresponding upward and downward slits of the longitudinal and transverse panels. The partition lattices so fabricated are collapsed planely for convenience of storage or the like. Therefore when they are inserted in cartons they must be opened so that the longitudinal and transverse panels cross at right angles. The lattices are then manually inserted into cartons. This manual operation apparently is inefficient because it is impossible to conduct to insert the lattices into cartons on a mass scale. To make things worse for enterprises in this field, workers dislike engaging in this simplistic work of simplicity.

A primary object of the present invention is to obviate the defect of the conventional method, and to provide an apparatus for automatically inserting a partition lattice into a carton held at a predetermined position while, also, opening a planely collapsed partition lattice so that the longitudinal and transverse panels of the lattice cross at right angles.

Further objects and features of the present invention will be more clearly understood from the following description given by way of examples with reference to the accompanying drawings as below:

Referring to FIGS. 1 to 6, a planely collapsible partition lattice A comprises longitudinal partition panels B and transverse partition panels C, both of which are made from thick boards such as corrugated papers. Equally spaced vertical slits D are provided in the panels B and C so as to extend from the upper or lower edges thereof to the middles thereof, corresponding upper and lower slits D of said partition panels B and C being engaged together so that the partition panels B and C of required numbers are formed into a partition lattice A.

A projection E is provided at the lower end of each slit D of the longitudinal panel B so as to engage a notch F provided in the lower edge of each transverse panel C, thereby preventing the longitudinal panels from moving out of the transverse panels.

The present partition lattice inserting apparatus comprises a partition lattice feeder G for feeding collapsed partition lattices parallelly arranged in a pile, a partition lattice opening device H in front of said feeder G for opening a leading partition lattice A so that the longitudinal and transverse partition panels B and C cross at right angles, a transfer device I in front of said opening device H for transferring an opened partition lattice A to a predetermined position, and a delivery device J for delivering and positioning a hollow carton to one side of said transfer device I in order to insert said partition lattice into the carton.

Figure 9:
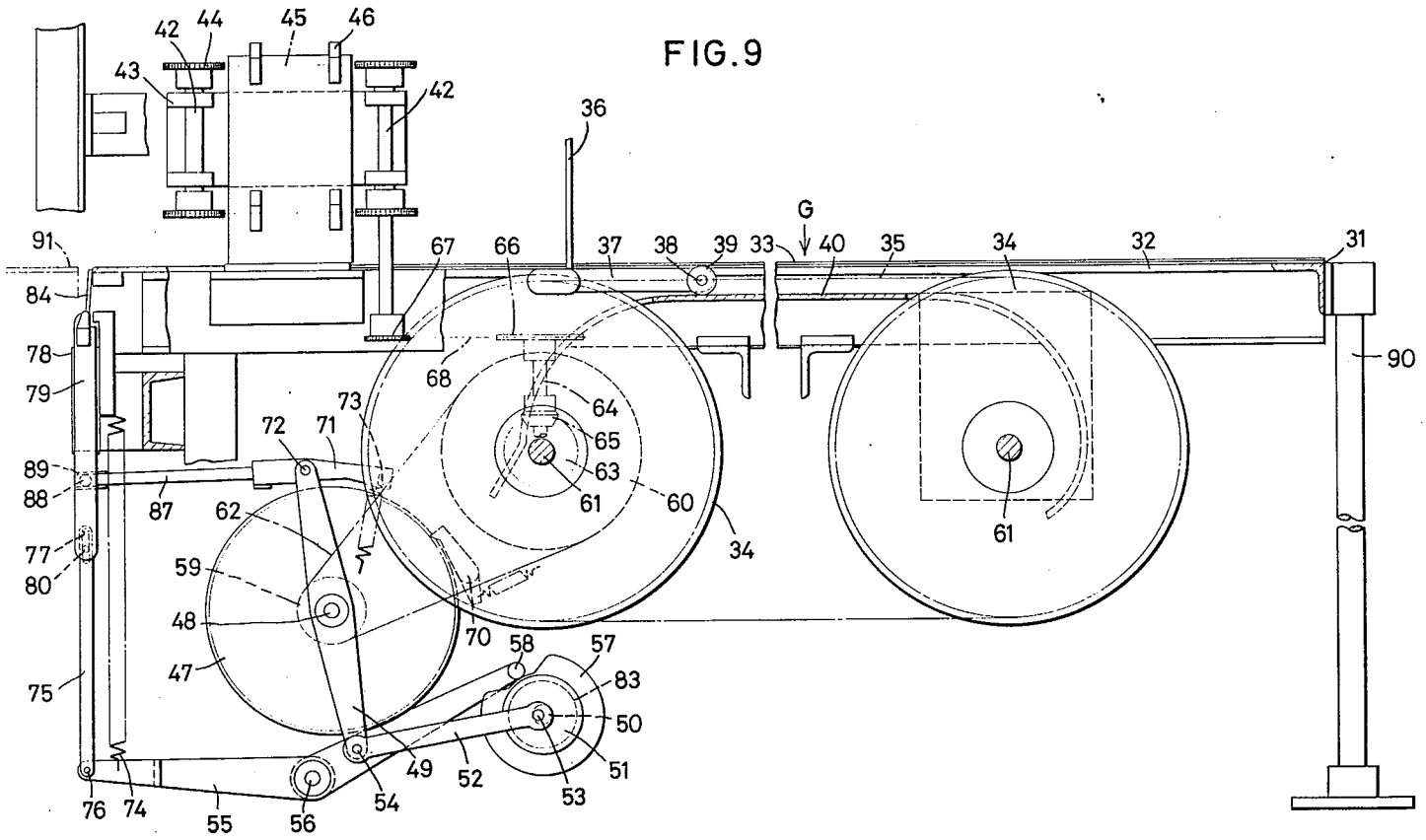
FIG. 9 is a longitudinally sectioned side view of the same.

Said feeder G will now be explained referring to FIGS. 7 to 10, As shown a table 31 having a horizontal upper face is arranged in the feeder G, an opening 32 being formed in said table 31 so as to longitudinally extend from the middle of the rear edge thereof towards the front portion. A plurality of guide plates 33 are mounted on said table 31 so as to extend at equal spaces parallel with the side edges of said table 31 from the rear towards the front portion thereof, said guide plates 33 being adapted to eliminate friction between the lower edges of the partition lattices A and the upper face of the table 31. Front and rear sprockets 34 are rotatably mounted in the opening 32 at the front and rear portions thereof respectively, and an endless chain 35 is entrained between said front and rear sprockets 34, and the conveying run of said chain 31 is adapted to travel slightly below the upper surface of said table 31. A pusher 36 for pushing the partition lattices is mounted on the outer periphery of the chain 35 at a predetermined interval, and a roller 39 is mounted at one end of each rod 37, the other end of which is secured to each side of said pusher 36. Said roller 39 is adapted to be on a rail 40, which is laid in a pair between said sprockets 34 right below the conveying run of said chain 35, so that the pusher 36 erects vertically when it moves along the conveying run of the chain 35 leftward as viewed in FIGS. 8 and 9. Vertical guide plates 41 are adapted to contact with both of the side edges of the partition lattices A in order to guide the collapsed lattices A positioned between the front and rear ends of said horizontal guide plates 33 when said lattices A are fed. Outside the front of said vertical guide plates 41 are rotatably mounted a pair of front and rear vertical shafts 42 by means of bearings 43. Upper and lower sprockets 44 are fixed to the upper and lower ends of each shaft 42 respectively, and an endless chain 45 is entrained between each corresponding front and rear sprockets 44 as best seen in FIG. 9. The inside runs of said chains 45, i.e. the sides corresponding with said vertical guide plates 41, facing each other at both sides of said table 31 are adapted to travel in the same direction as the conveying run of said chain 35 and to approach nearer at the front portions of said inside runs. Projecting pieces 46 are mounted at equal intervals on the outer periphery of said chain 45 for forcing forward the partition lattices A by engaging with the side edges thereof.

A gear 47 is rotatably mounted in front of said front sprocket 34, and a rocking plate 49 is journaled at the middle thereof on a shaft 48 of said gear 47 so as to be freely rotatable in respect to said shaft 48. A driving shaft 50 rotating in one direction is positioned right below said front sprocket 34; a disc 51 is fixed at the center thereof to the end of said driving shaft 50; a link 52 is pivoted at one end thereof on said disc 51 by a pin 53 eccentrically with respect to the shaft 50; and the other end of said link 52 is pivotally connected to the lower end of said rocking plate 49 by means of a pin 54. A bell crank lever 55 is longitudinally arranged below said gear 47, said lever 55 being rotatably supported at the middle thereof by means of a shaft 56. A cam 57 is fixed to the driving shaft 50, said cam 57 having a recess at the periphery thereof, and a roll 58 is mounted at one end of the lever 55 contacting with the upper periphery of said cam 57. A sprocket 59 is mounted on the shaft 48 so as to rotate together with the gear 47. A sprocket 60 is mounted on a shaft 61 of the front sprocket 34 so as to rotate together therewith. A chain 62 is entrained between said sprockets 59 and 60.

Figure 7:
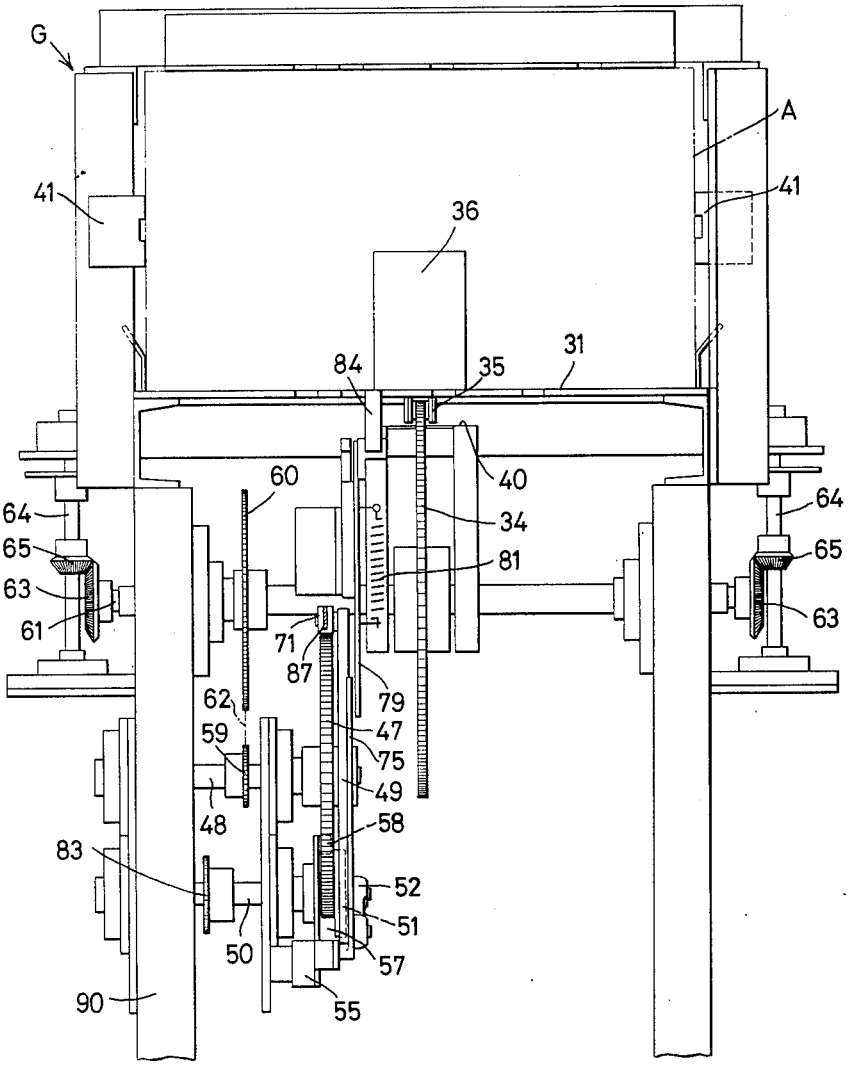
FIG. 7 is a transversely sectioned front view of a partition lattice feeder.
Figure 8:
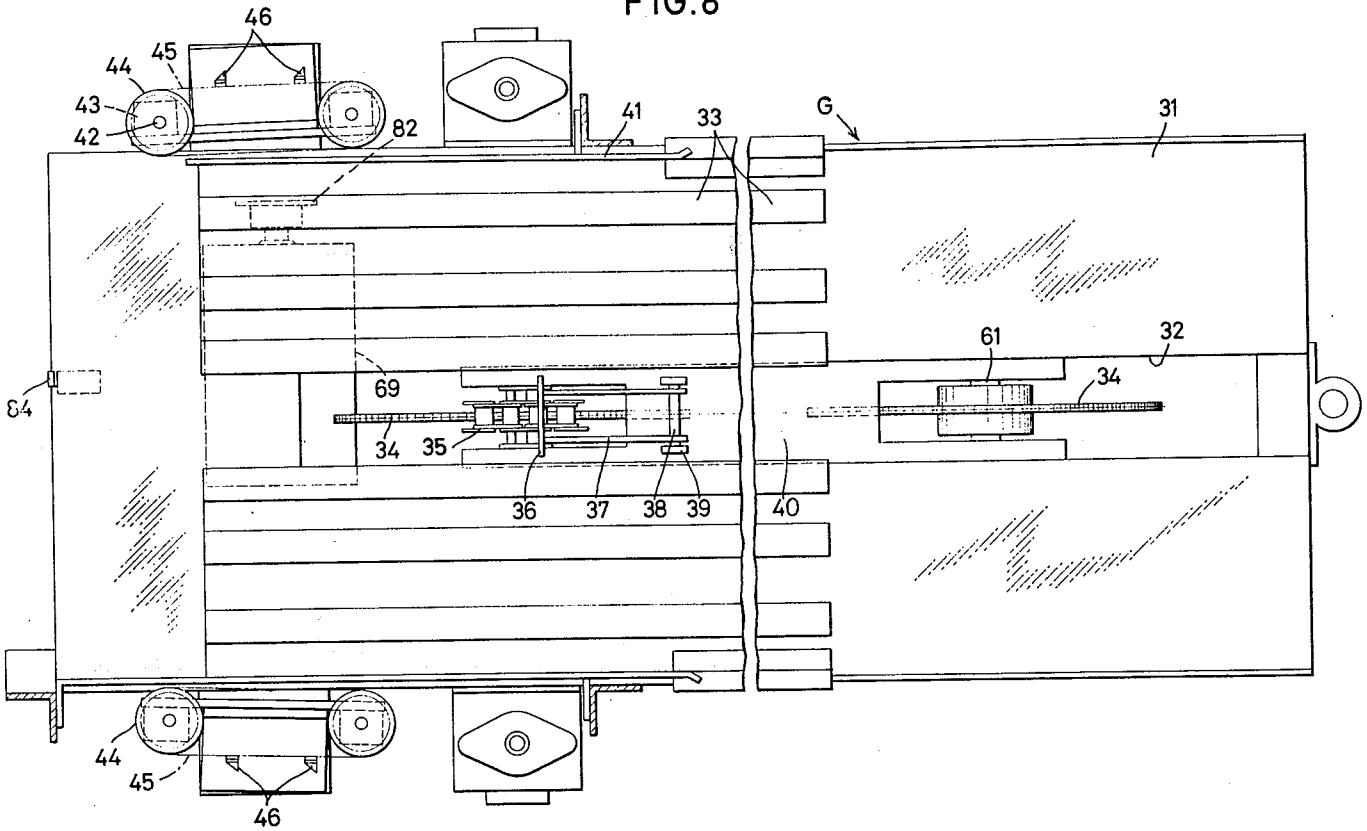
FIG. 8 is a plan view of the same.

The numeral 63 designates a bevel gear secured on the shaft 61, said gear 63 meshing with a gear 65 which is fixed to a rotatable shaft 64 at the lower end thereof, a chain 68 being entrained between a sprocket 66, which is fixed to the shaft 64 at the upper end thereof, and a sprocket 67 which is fixed to the lower end of the shaft 42, thereby transmitting the rotation so that the chain 35 runs synchronously with the chain 45, as shown in FIGS. 7 and 9.

Said driving shaft 50 is driven by a transmission mechanism comprising a chain entrained between a sprocket 83 of the driving shaft 50, and a sprocket 82 of a motor 69 which is mounted right below the table 31.

A pawl 70 engages with the gear 47 for preventing the clockwise rotation thereof. A rotary plate 71 is rotatably mounted at the middle thereof by means of a pin 72 on the upper end of the rocking plate 49, and a click 73 is provided on the rotary plate 71 at the rear end thereof for engaging with the teeth on the upper periphery of the gear 47 when the rear end of the rotary plate 71 descends.

Figure 10:
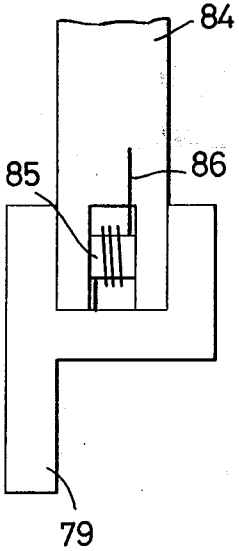
FIG. 10 is a front view of a detector for a leading partition lattice fed by said feeder.

A spring 74 biases said bell crank lever 55 so that the front end of the lever 55 is pulled upward. An elevatable link 75 is pivotally connected at the lower end thereof to the lever 55 at the front end thereof, and a vertical slot 77 is formed in the upper end portion of the elevatable link 75. In said slot 77 is inserted a pin 80 fixed to the lower end of an elevatable member 77, the upper end of which is arranged to position just below the front edge of the table 31 and which is elevated and lowered by means of a guide member 78. Said elevatable member 79 is biased upward by means of a spring 81, as shown in FIG. 7. A turnable piece 84 is rotatably mounted at the upper end of said elevatable member 79 by means of a pin 85, said turnable piece 84 being adapted to turn forward from the vertical position so that the upper edge thereof directs forward and it is restored to its vertical position by means of a spring 86 coiled around the pin 85, one end of which is engaged with said turnable piece 84 and the other end is engaged with said elevatable member 79, as shown in FIG. 10. Said turnable piece 84 is adapted to project above the table 31 so that the rear face of the piece 84 passes near the front edge of the table 31, so as not to contact therewith, and to sink below the table 31, so that the upper end of the piece 84 positions below the upper face of the table 31. A rod 87 extends rearward from the rotary plate 71, a roll 88 provided at the front end of said rod 87, is slidably fitted in between the upper and lower rails 89 provided in a pair on the lower portion of the elevatable member 79 at one side thereof. A machine frame 90 supports the table 31 and other members.

Figure 11:
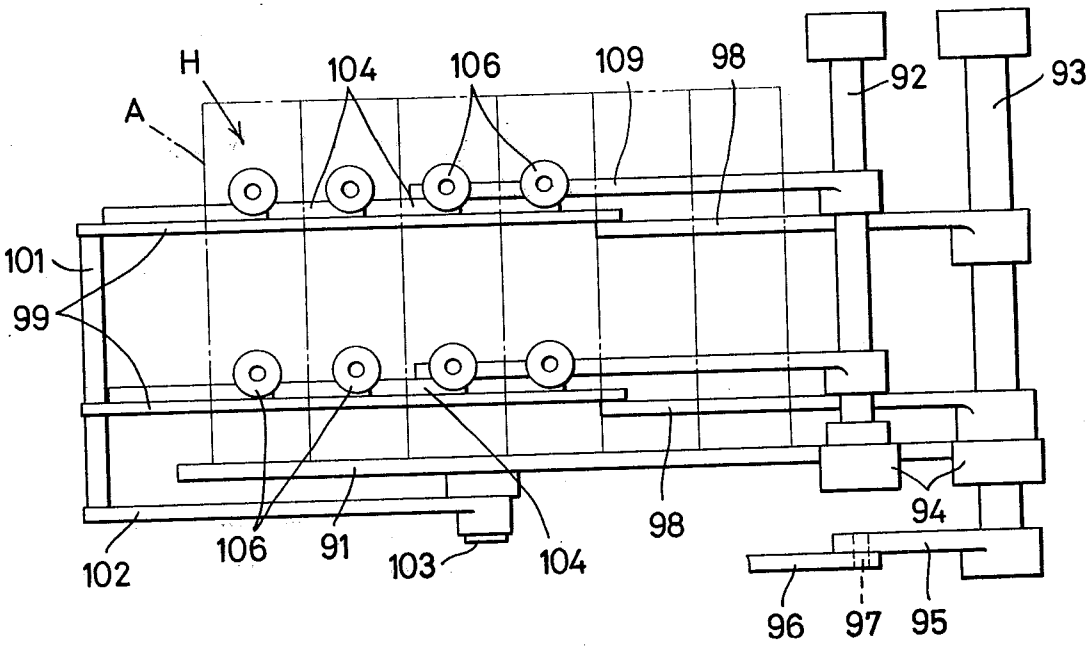
FIG. 11 is a rear view of a partition lattice opening device.
Figure 12:
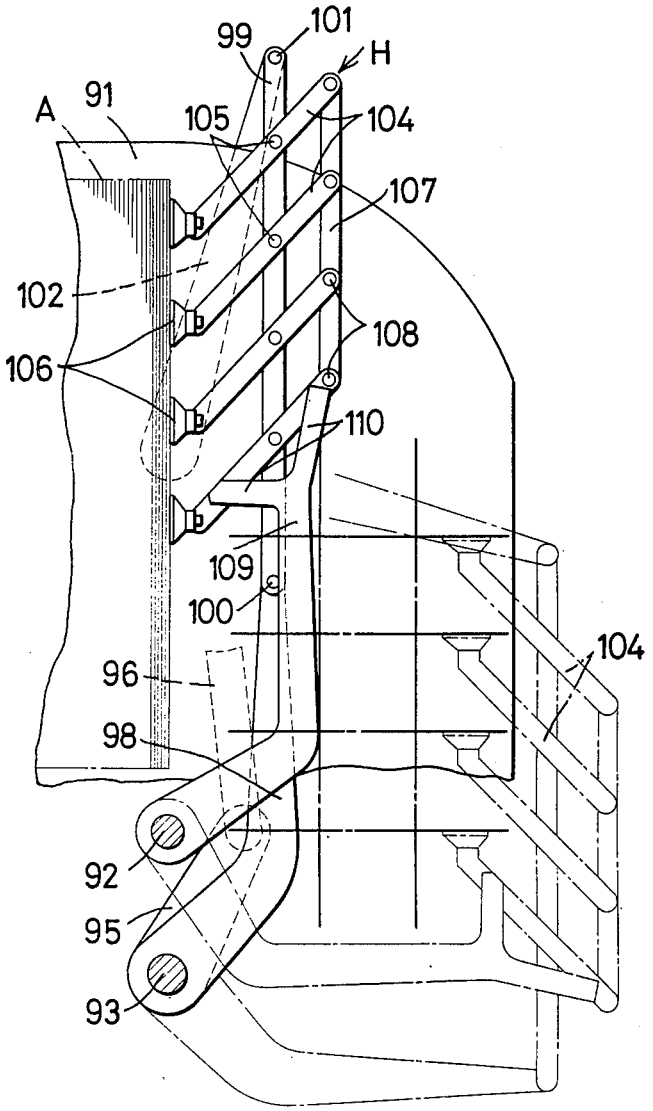
FIG. 12 is a plan view of the same.

Said partition lattice opening device will now be explained with reference to FIGS. 11 and 12.

An auxiliary table 91 is disposed in front of said table 31 with an interval between the two tables 31, 91, whereby the turnable piece 84 can move up and down and operate between the front edge of the table 31 and the rear edge of the table 91. The auxiliary table 91 can be constructed integrally with the table 31. In this case an opening is formed for the operation and upward and downward movement of said turnable piece 84.

A vertical shaft 92 is positioned outward from the one side (the side where the delivery device J is positioned) of the leading lattice A; another vertical shaft 93 is disposed further outward from said shaft 92. Both shafts 92 and 93 are rotatably journaled by bearings 94. A projecting piece 95 is fixed at one end thereof to the lower end of the shaft 93, and a movable plate 96 is pivotally connected with the front end of said projecting piece 95 by means of a pin 97, whereby the shaft 93 is forced to rotate clockwise or counterclockwise by the forward or backward movement of the movable plate 96 as viewed from FIG. 12. Turning plates 98 having L-shaped planes are fixed at their ends to the lower and upper end portions of the shaft 93 so as to be positioned at the lower and upper edges of the partition lattice A, respectively. The front portions of said turning plates 98 are arranged parallel with the front face of the leading lattice A. Rotary plate members 99 are pivotally connect at the ends thereof to the ends of the turning plates 98 by means of pins 100; said plate members 99 are parallel to the front face of the lattice A. A rod 101 connects the ends of the upper and lower plate members 99; a revolving plate 102 positioned below said auxiliary table 91 is rotatably connected at one end thereof to the lower end of said rod 101; and the other end of said revolving plate 102 is rotatably supported below the auxiliary table 91 by a shaft 103 which is arranged substantially at the middle between both ends of the lattice A under the table. The shafts 93 and 103 are spaced equally with the length of the plate members 99, and the distances between both ends of the turning plates 98 and that of the revolving plate 102 are adapted to be equal in straight lines, thereby arranging a quadrilateral formed by said four members to be a parallel quadrilateral. Said rod 101 is adapted to move outside of the peripheral edge of the auxialiary table 91.

Arms 104 spaced equally and in the same number with the transverse partition panels C are pivoted at the middle thereof by pins 105 on the upper and lower plate members 99 between both ends thereof. A suction disc 106, the suction face of which opposes to the lattice A, is secured to the end of each arm 104; a suction hose (not shown) communicating with a pump is connected to each suction disc 106. A connecting rod 107 to which is pivotally connected the end of each arm 104 by a pin 108. Said arms 104, when said plate members 99 are at the nearest position in relation to the leading lattice A, are adapted to incline at 45° in respect to said plate members 99 and to have said suction discs 107 abut on the front face of each transverse partition panel C of the leading lattice A, as seen from FIG. 12.

Plate members 109 having an L-shaped plane are positioned slightly above said plate members 99. One ends of said plate members 109 is rotatably supported by the shaft 92, and a forked projection 110 is integrally formed at the other end of each plate member 109. The ends of said forked projection 110 are fixed to both end portions of the arm 104 positioned at the right end.

Said transfer device I will now be described in reference to FIGS. 13 to 21.

Figure 20:
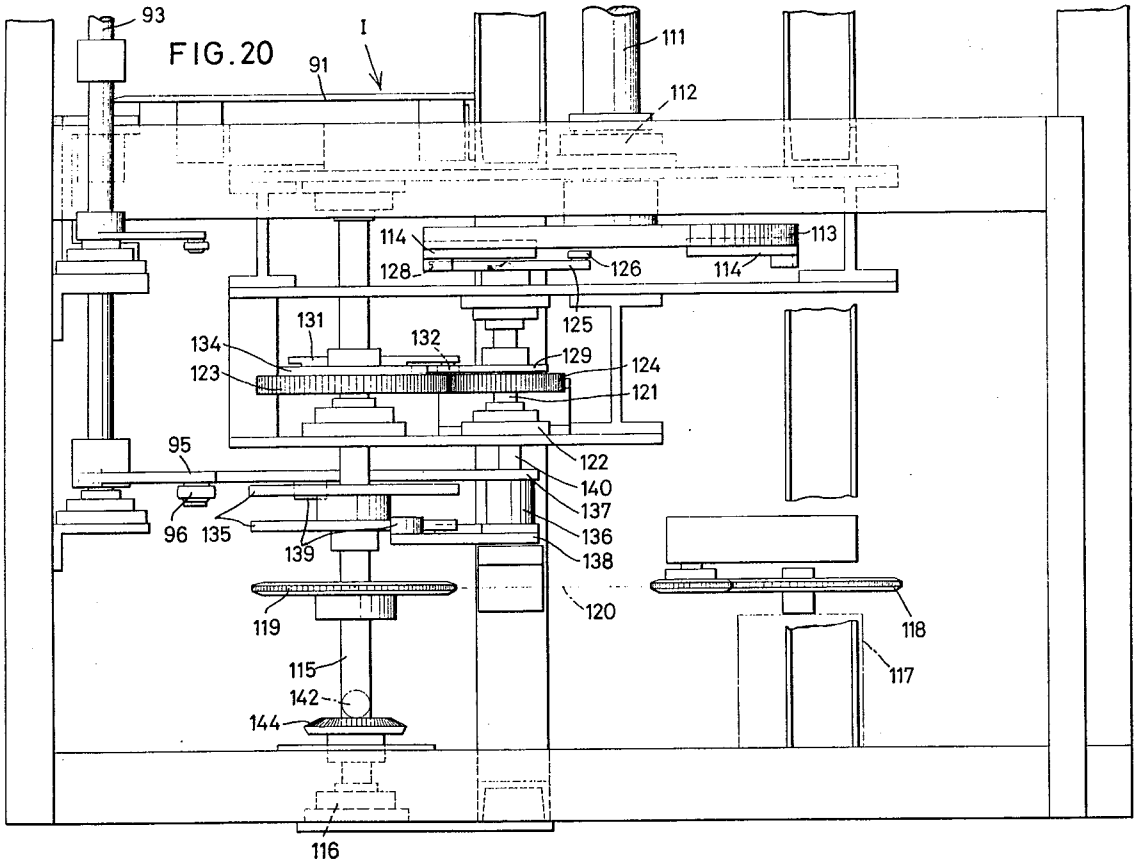
FIG. 20 is a vertically sectioned side view showing a driving mechanism for the means of FIG. 13.

A vertical shaft 111 is rotatably supported by a bearing 112 so as to be positioned at the front of the opened lattice A. A circular table 113 is fixed at the center thereof to said shaft 111 at the lower end thereof and positioned below the auxiliary table 91 as seen in FIG. 20. Said circular table 113 is turned in one direction at an inclination of 90°. For this purpose, four pair of radial guide rails 114 are provided at equal intervals on the lower face of said circular table 113, and said guide rails 114 extend from the periphery of the circular table, as shown in FIG. 21.

Figure 21:
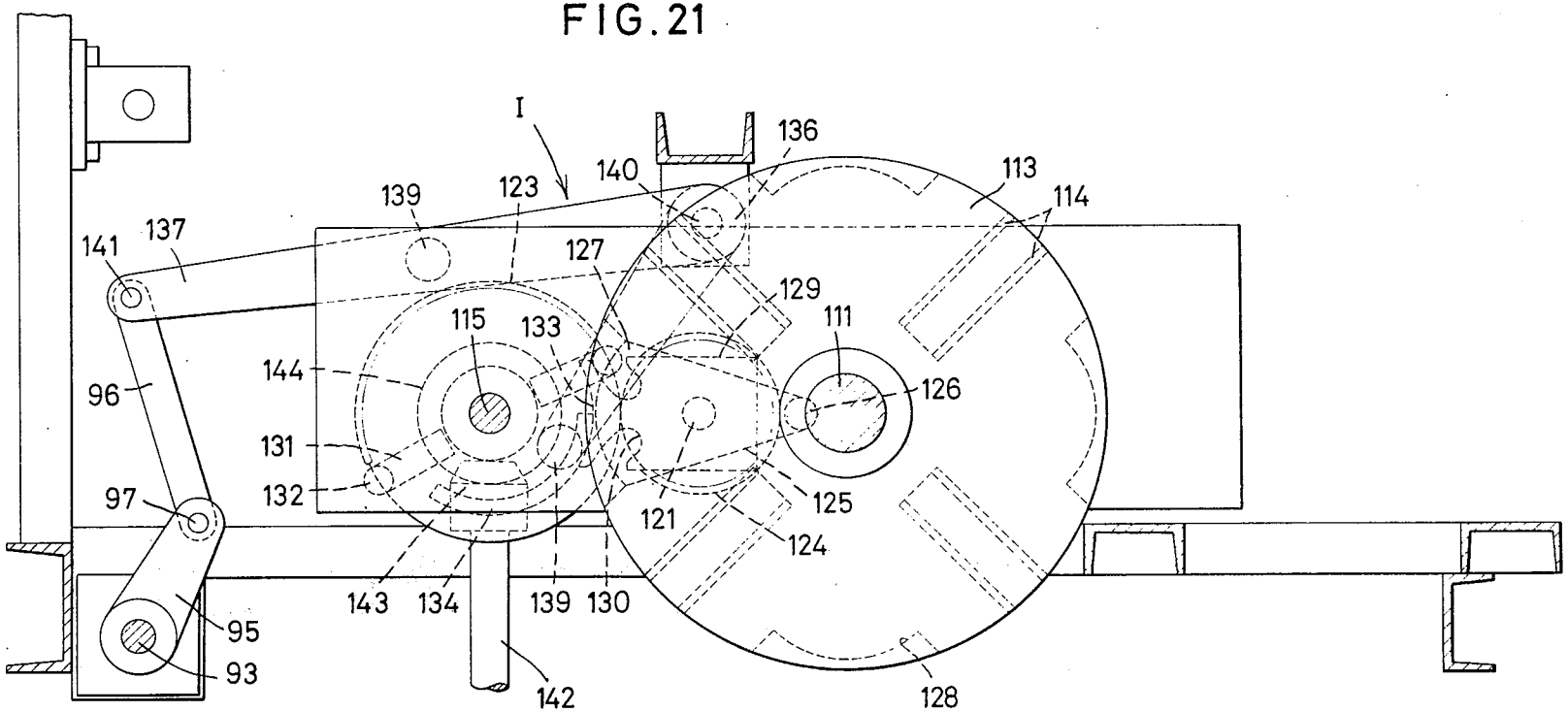
FIG. 21 is a cross sectional plan view of the same.
Figure 22:
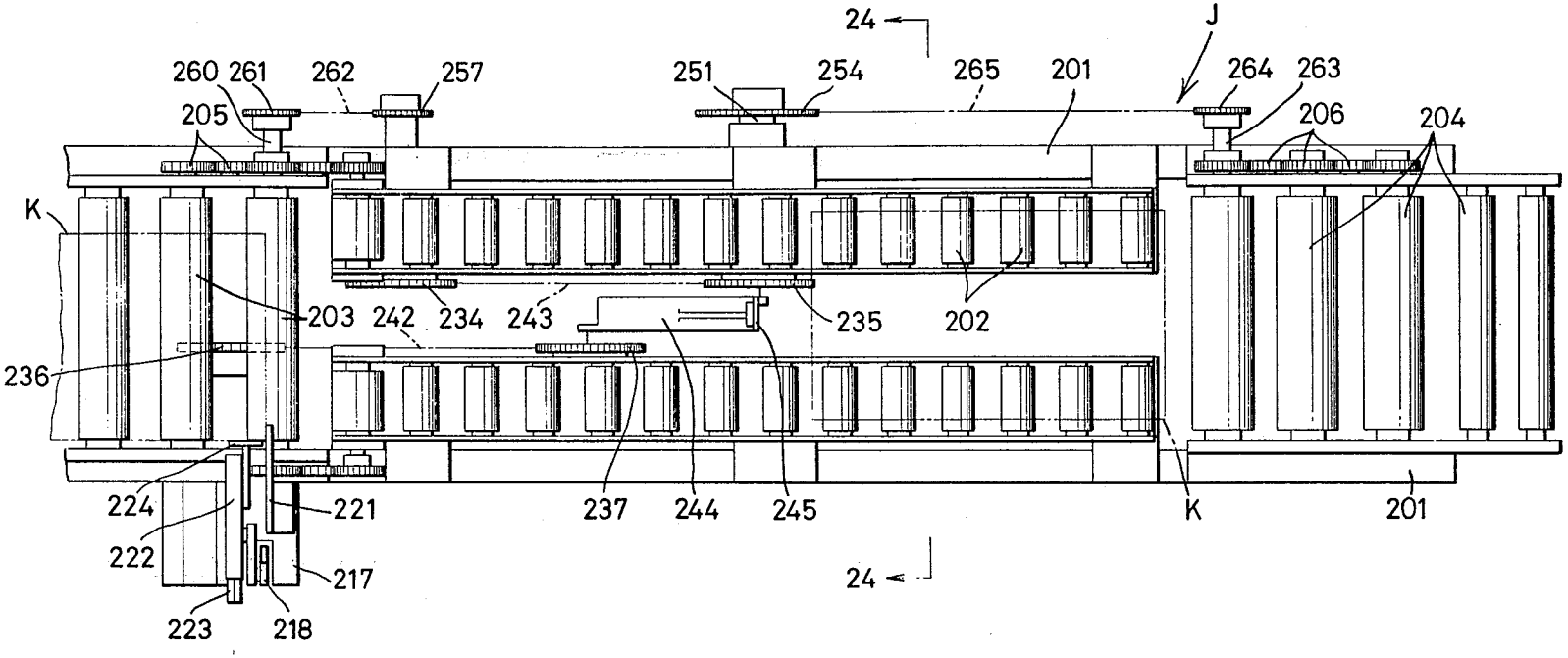
FIG. 22 is a plan view showing a carton delivery device.
Figure 23:
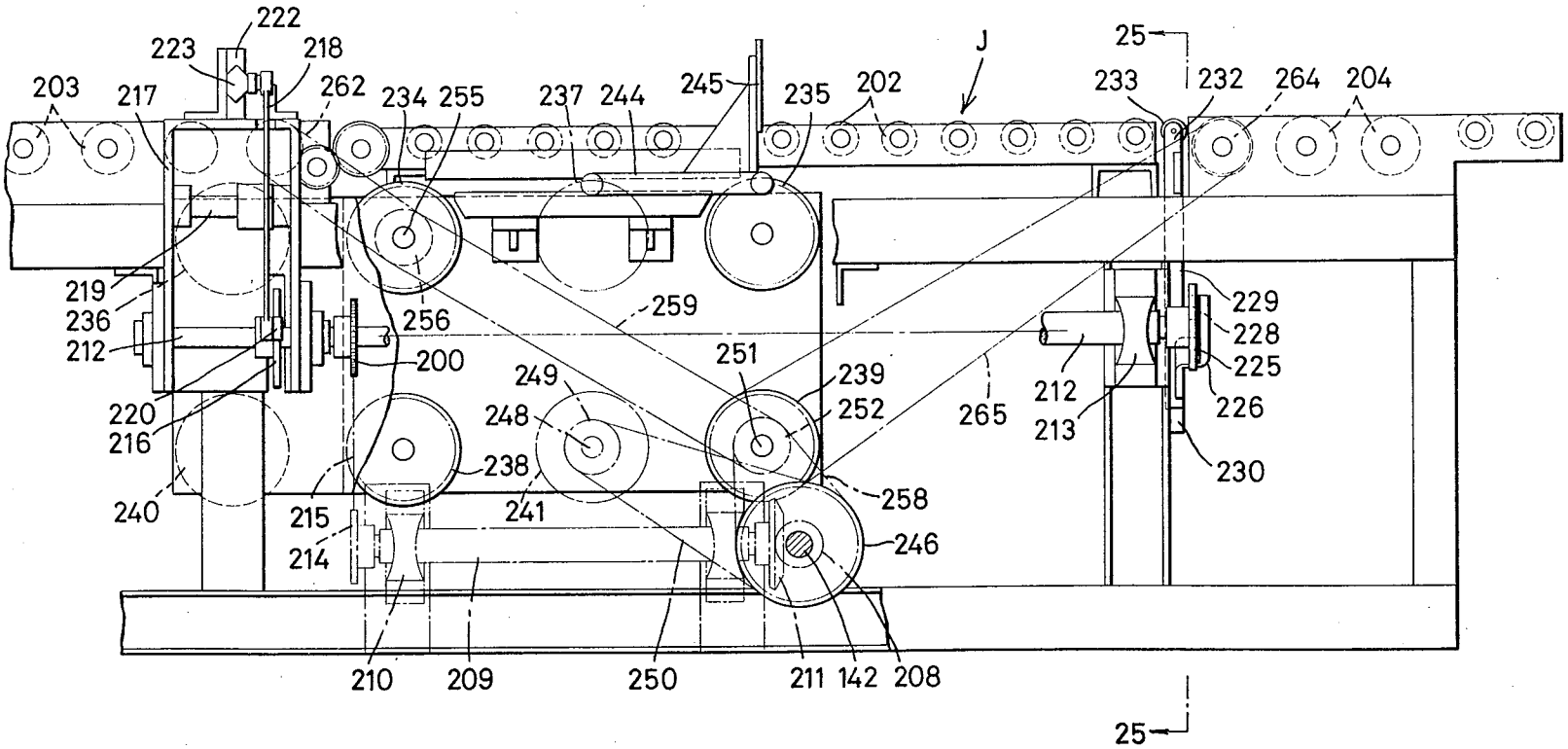
FIG. 23 is a side view of the same.

A shaft 115 is rotatably supported at both ends thereof by bearings 116 positioned at the rear of said shaft 111, said shaft 115 being driven at a constant speed clockwise in FIG. 21 by a chain entrained between a sprocket 119 fixed to the lower end of said shaft 115 and a sprocket 118 provided on an output shaft of a driving means 117 comprising a motor and a reduction mechanism. A shaft 121 is rotatably supported at both ends thereof by bearings 122 in front of said shaft 115 parallel therewith. A gear 123, the teeth of which are partially broken, and a movable gear 124 are securely mounted on said shafts 115, 121 at the middles thereof, respectively. The diameter ratio of the gear 123 to the gear 124 is 1:0.6, and the angle of the tooth broken portion of the gear 123 is 160°.

An upper rotary plate 125 is securely mounted onto the shaft 121 at the upper end thereof, and a roll 126 is mounted onto the upper face of said upper rotary plate 125 at one end thereof and is adapted to pass along the guide rails 114 during the rotation of the rotary plate 125. A sector projection 127 is further provided on the upper rotary plate 125 between both side edges of the other end thereof.

An arc-shaped recess 128 is provided on the lower face of the circular table 113 at the peripheral portion thereof between each guide rail 114 so as to engage with said sector projection 127 when contacted thereby, said circular table 113 being prevented from rotating when said sector projection 127 engages in said recess 128. A lower rotary plate 129 is mounted on the shaft 121 above the movable gear 124, and notches 130 of U-shape slant inward from one end portion (the side at the periphery of the circular table 113) of the lower rotary plate 129. A pair of arms 131 are mounted above the gear 123 rotatably together therewith. One end of said arms 131 is directed towards the ends of the tooth broken portion of the gear 123, and a roll is mounted on the lower face of each of said arms 131 at the end as above-referred to, so that the center of the roll 132 corresponds with the circle of said tooth broken portion of the gear 123, and so that the roll 132 fits into said notch 130 in the way of turning of the arm 131. An arc-shaped recess 133 is provided in the lower rotary plate 129 at the front end thereof. An arc-shaped projection 134 is provided on the upper face of the gear 123 adjacent to the periphery of the tooth broken portion of the gear 123 so as to engage in said arc-shaped recess 133 during the rotation of the gear 123. By the contacting of said projection 134 with the recess 133, the lower rotary plate 129 is prevented from rotating after it stops at a predetermined position. A pair of upper and lower cams 135 are secured to the shaft 115 below the gear 123. A cylindrical member 136 is mounted on the lower end of a shaft 140 by the side of the shaft 121, and said cylindrical member 136 is rotatable in respect to the shaft 140. One end of a rocking plate 137 is fixed to the cylindrical member 136 at the upper end thereof, and one end of another rocking plate 138, shorter than said plate 137, is fixed to the lower end of the cylindrical member 136. Rolls 139, which engage with the upper and lower cams 135, respectively, are rotatably mounted at the middle of the longer rocking plate 137 and at the other end of the shorter rocking plate 138 respectively, thereby enabling both rocking plates 137 and 138 to rock synchronously. The other end of said longer rocking plate 137 is pivotally connected to one end of the movable plate 96 by means of a pin 141, thereby adapting the shaft 93 for rotation clockwise and counterclockwise in FIG. 21.

A bevel gear 143, which is secured to one end of a driving shaft 142 of the delivery device J, mesh with a bevel gear 144 secured to the lower end of the shaft 115.

Figure 13:
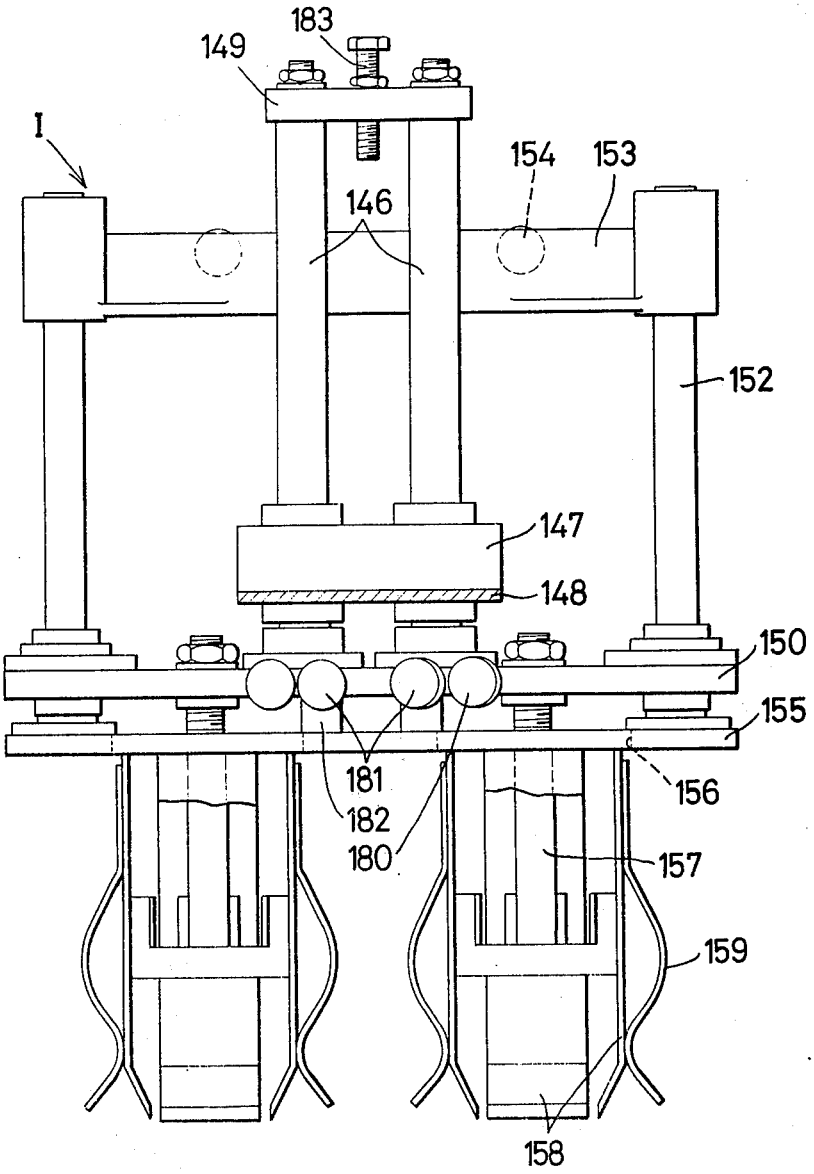
FIG. 13 is a means for supporting and transferring an opened partition lattice.
Figure 14:
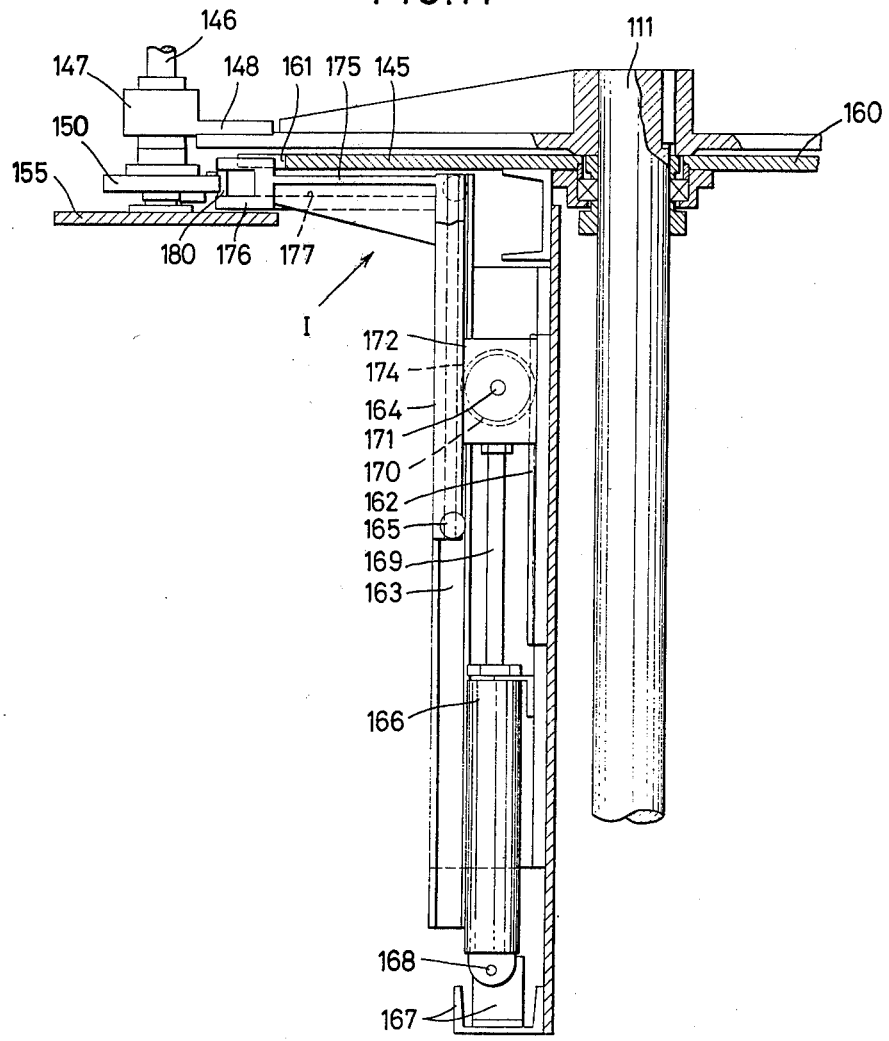
FIG. 14 is a side view showing a means for elevating and lowering the means of FIG. 13, partially sectioned.
Figure 16:
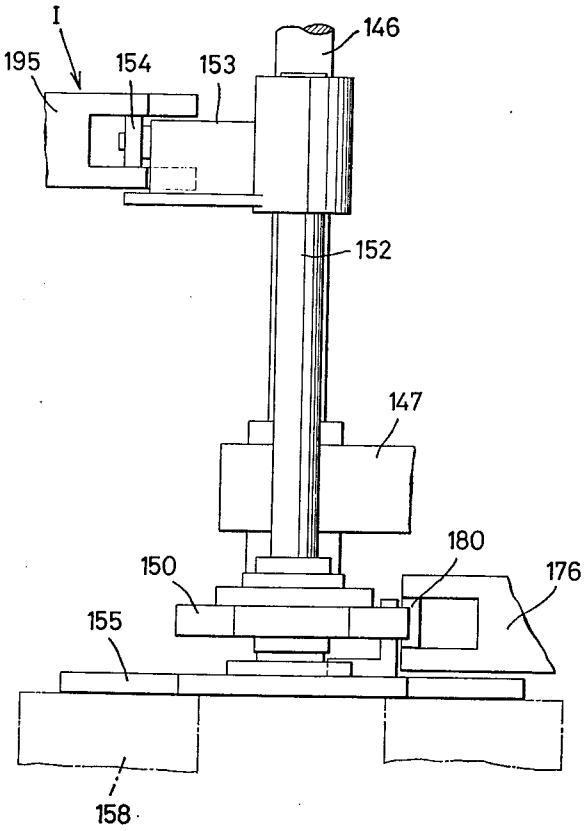
FIG. 16 is a side view showing a part of said means of FIG. 14 for receiving upper and lower rolls provided on said means of FIG. 13.
Figure 15:
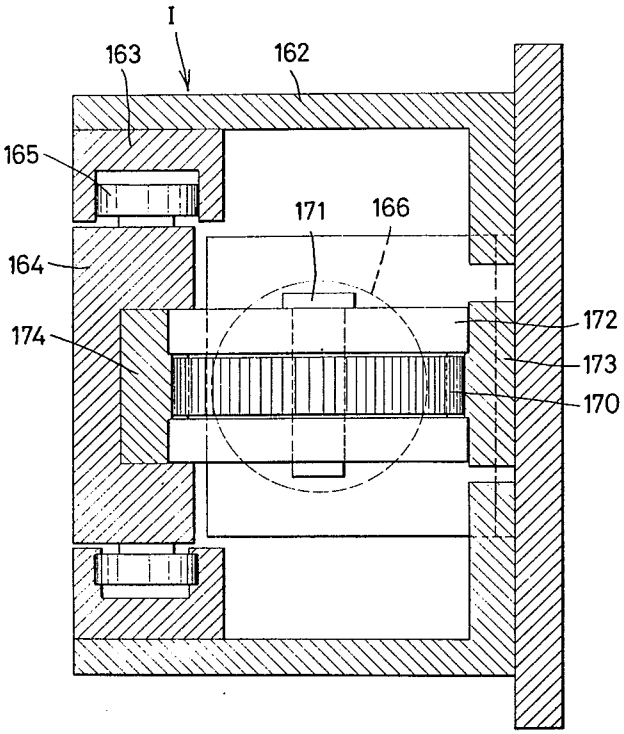
FIG. 15 is a transversely sectioned plan view of the same.
Figure 17:
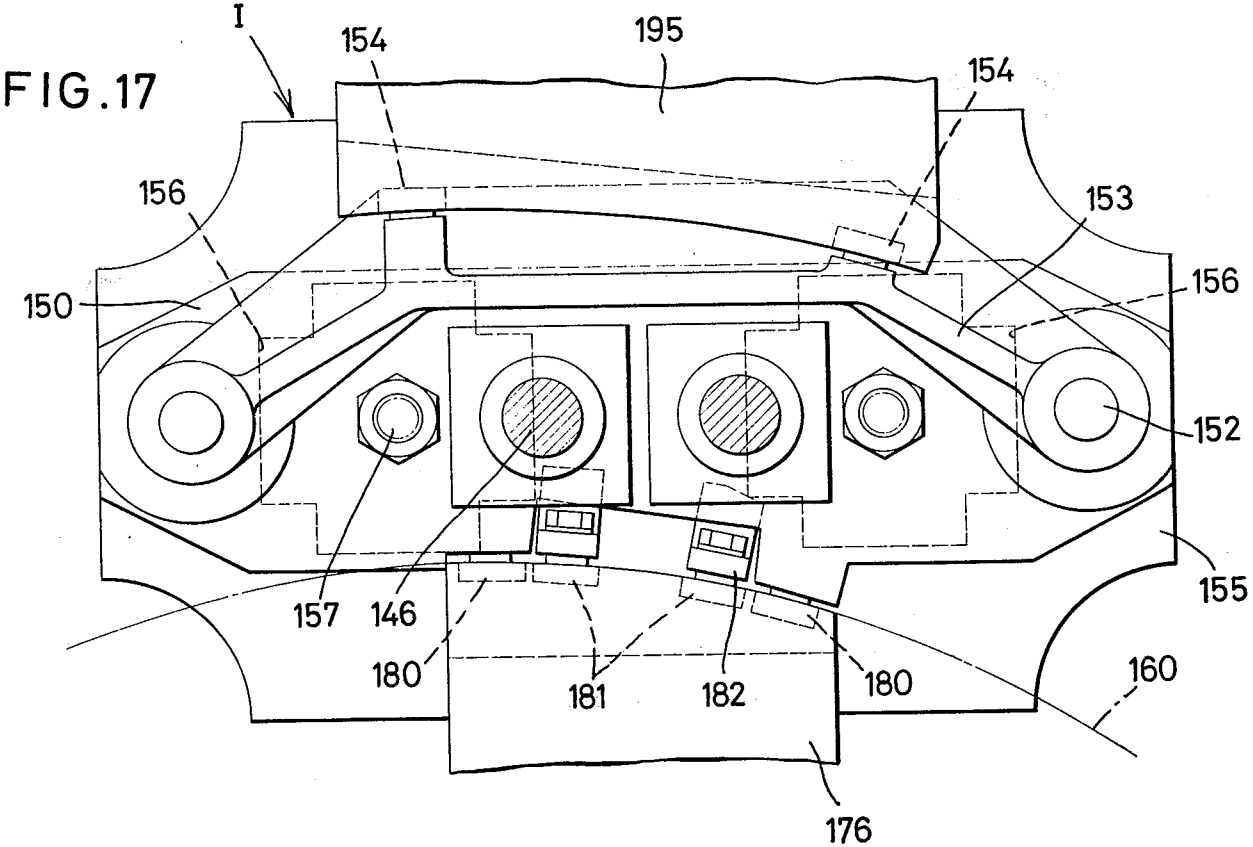
FIG. 17 is a plan view of the same.

In FIG. 14, horizontal arms 145 radially project from the upper end of the shaft 111 at tetrasectional intervals thereof, and a mounting piece 148 is fixed to the front end of each horizontal arm 145 for fixing a bearing member 147 in which right and left parallel shafts 146 are elevatably inserted, as shown in FIGS. 13 and 14. A connecting plate 149 securely connects with the upper ends of the shafts 146, and a plate member 150 also connects at the center thereof to the shafts 146, 146 at the lower ends thereof. Elevatable shafts 152 are vertically inserted into both end portions of the plate member 150, the upper ends of the shaft 152 being integrally connected by means of a connecting member 153. Rolls 154 are mounted on the connecting member 153 at both sides of the front face thereof. An elevatable plate 155 below said plate member 150 is secured to said elevatable shafts 152 at the lower ends thereof. Rolls 180, 181 are mounted at the same level adjacent to the rear edge of the plate member 150 (at the side where the mounting piece 148 positions) so as not to make too much clearance between each other, said rolls 180 being mounted on the rear edge of the plate member 150 and said rolls 181 being mounted on leg members 182 which are fixed to the upper face of the elevatable plate 155, so that the rolls 181 on the elevatable plate 155 position between the rolls 180 on the plate member 150 at the same level with the rolls 180, as shown in FIGS. 13, 14 and 17.

A stopper 183 is threaded through the connecting plate 149 at the center thereof so as to be vertically movable by revolving it, said stopper 183 being adapted to prevent the plate member 150 from lowering further by contacting with the upper face of the bearing member 147 when said plate member 150 is lowered together with said elevatable plate 155. Openings 156 are provided in the elevatable plate 155 at both end portions thereof, and a shaft 157 is fixed at the upper end thereof to the plate member 150 and penetrates each opening 156 at the center thereof. An engaging member 158 comprising four plates opposite to each other is fixed to the lower end of said shaft 157, said engaging member 158 being fittable in one partition square surrounded by the longitudinal and transverse partition panels B and C. Resilient clips 159 are fixed at the upper ends thereof to one of the corresponding faces of the engaging member 158, and the transverse partition panels C are held by these clips 159 and the engaging member 158 when the engaging member 158 is inserted into one partition square surrounded by the longitudinal and transverse partition panels B and C. The lower end of said clip 159 is curved outwardly away from the outside face of the engaging member 158 so as not to collide against the upper edges of the transverse partition panels C.

A stationary disc 160 is provided below the horizontal arms 145, and the upper end portion of the shaft 111 rotatably penetrates the center of said stationary disc 160. Square notches 161 are provided in the periphery of the stationary disc 160 at the portion positioned in front of the opening device H and at the portion confronting the delivery device J, respectively. As best seen from FIGS. 14 and 15, a post 162 is erected in front of the square notch 161 confronting the opening device H, the upper end of said post 162 being supported by the stationary disc 160 at the lower face thereof. A pair of right and left rails 163 is provided, and an elevatable body 164 is inserted between said rails 163. Wheels 165 are attached to both sides of said elevatable body 164 and fitted into grooves provided in said rails 163. A cylinder 166, at the lower end thereof is pivoted by a pin 168 on a bracket 167 provided on the lower end of the post 162. A pinion 170 is rotatably mounted by means of a horizontal pin 171 in a forked piece 172 provided on the upper end of a piston 169 of said cylinder 166. A rack 173 meshing with said pinion 170 is fixed to the post 162 at the rear thereof; another rack 174 meshing also with said pinion 170 is secured to the elevatable body 164. The front and rear vertical faces of the forked piece 172 are moved up and down while being guided along guide faces provided at both sides of the racks 173 and 174.

A horizontal plate 175 is provided at the upper end of the elevatable body 164 so that the front end of the horizontal plate 175 is positioned just below the notch 161 adjacent to the opening device H. A rail 176 is secured to the horizontal plate 175 at the front end thereof for receiving said rolls 180, 181 when said elevatable body 164 is elevated to its uppermost position, thereby inserting the rail 176 in the notch 161. Said rail 176 is opened at both sides and the front face thereof adjacent to the opening device H.

A rail 177 is provided on the peripheral portion of the lower face of the disc 160 except the notches 161, and the rolls 180, 181 are being guided along the rail 177 while riding on it when said horizontal arm 145 is rotated.

Figure 18:
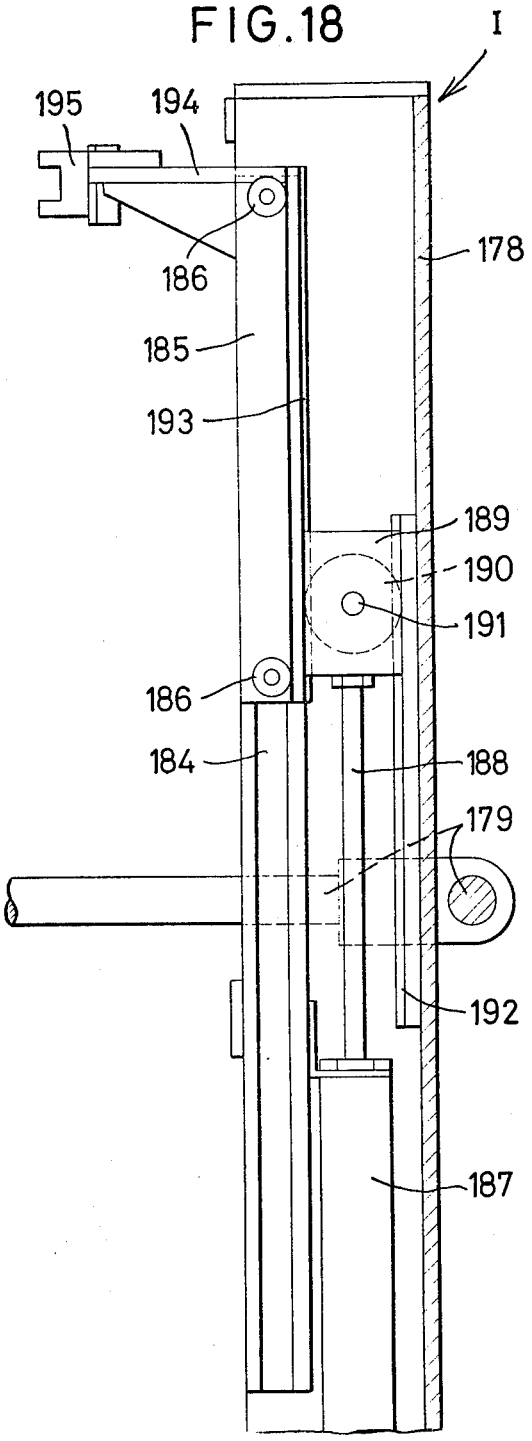
FIG. 18 is a side view showing a means for elevating and lowering said means of FIG. 13 so as to insert a partition lattice in a carton, partially sectioned.
Figure 19:
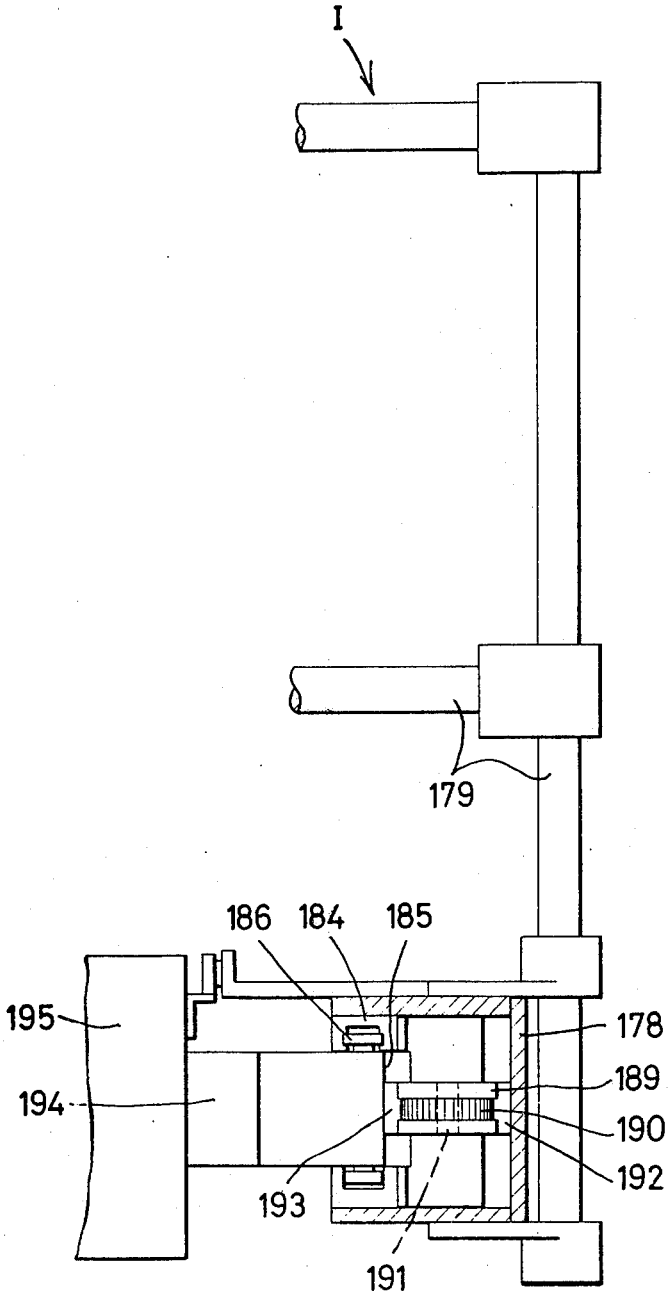
FIG. 19 is a transversely sectioned plan view showing the main part of the same.

In FIGS. 18 and 19 a post 178 is erected outside the notch 161 corresponding to the side edge of the delivery device J, said post 178 being supported by a horizontal shaft 179. Front and rear rails 184 in a pair are secured inside the post 178, and an elevatable body 185 is mounted between said rails 184, i.e. wheels 186 rotatably mounted at both sides of the elevatable body 185 are inserted into grooves provided in said rails 184. A cylinder 187 is supported in the lower portion of the post 178; a forked piece 189 is attached to the upper end of a piston rod 188 of the cylinder 187; and a pinion 190 is rotatably mounted on said forked piece 189 by means of a horizontal pin 191. A rack 192 is formed on the post 178 so as to mesh with the pinion 190, and a rack 193 is attached to the elevatable body 185 so as to mesh with the pinion 190, said racks 192, 193 being vertically arranged. The forked piece 189 is adapted to move vertically up and down as the front and rear vertical faces thereof are guided along the guide faces formed at both sides of the racks 192 and 193. A horizontal plate 194 has fixed to the upper end of the elevatable body 185, and a rail member 195 opened at both ends thereof comprising one side facing the rolls 154 is fixed to the other end of said horizontal plate 194, so that the rolls 154 ride on the rail 195 just before the plate member 150 and the elevatable plate 155 stop to turn at the position confronting the delivery device J from the position where they confronted the opening device H.

Next the delivery device J for cartons K will be described with reference to Gears to 25. Right and left side frames 201 are opposed to each other so that both ends thereof direct forward and backward. Two lines of roller conveyors 202 are laid on the side frames 201 at the upper inside edges thereof at both side portions in the delivery device J. A feeding roller conveyor 203 has a forward end moving in the direction positioned adjacent to the backward ends of the roller conveyors 202, and a sending-out roller conveyor 204 is positioned so that the backward end thereof abuts on the forward end of the roller conveyors 202. The gears 205 are provided on the rollers of the feeding roller conveyor 203 so that each roller thereof rotates in one direction through intermediate gears, and additional gears 206 are attached to the ends of the rear three rollers of the sending-out conveyor 204 so that the gears 206 rotate in one direction through intermediate gears.

Said driving shaft 142 is journaled at both ends thereof in bearings 207 on both side frames 201 so as to be positioned just below the roller conveyor 202 at the middle between both ends of the roller conveyors 202. A bevel gear 208 is fixed to one end of the driving shaft 142. A shaft 209 is supported by bearings 210 on the side frame 201 parallel with the roller conveyors 202, and a bevel gear 211 meshes with said bevel gear 208 fixed to the front end of said shaft 209. A horizontal shaft 212 is supported by bearings 213 on the side frame 201 so as to be positioned right above the shaft 209. One end of said shaft 212 is positioned at the front end of the feeding roller conveyor 203, and the other end thereof is positioned at the backward end of the sending-out roller conveyor 204. A sprocket 200 is fixed to one end of the shaft 212, and a chain 215 is entrained between said sprocket 200 and a sprocket 214 secured to the shaft 209 at one end thereof. A cam fixed to the shaft 212 at one end thereof. A support frame 217 is attached to the outside face of one of the side frames 201 at the position where the cam 216 is provided; a rocking plate 218 directed upward is rotatably supported in this frame 217 at the middle of the plate 218 by means of a pin 219; and a roll 220 contacting the periphery of the cam 216 is mounted on the rocking plate 218 at the lower end thereof.

A stopper 221 is provided above the roller conveyor 203 at one side of the front end thereof, said stopper 221 being adapted to hold the carton K fed by the conveyor 203 in contact with said carton K at one of front side edges thereof. Two lines of upper and lower guide rails 222 are located behind the stopper 221. A slider 223 projectable above the roller conveyor 203 is slidably supported in said guide rails 222; a vertical plate 224 is secured to the slider 223 at the right end thereof; and a pin on the left end of the slider 223 is inserted in a vertical slot provided in the upper end portion of the rocking plate 218, thereby enabling the slider 223 to advance to cause the vertical plate 224 to project beyond the top of the stopper 221 and to release the carton K from the grip of the stopper 221 so as to proceed further forward. A cam 225 is fixed to the shaft 212 at the other end thereof. A lever 266 is rotatably mounted at the middle thereof by a pin 227, and a roll 228 contacting said cam 225 is mounted on the lever 226 at the outward end thereof, thereby enabling the other end of the lever 226 to move up and down. Two lines of vertical guide rails 229 are positioned right below the space between the roller conveyor 202 and the sending-out roller conveyor 204, and an elevatable body 230 is supported between the guide rails 229, the lower end of said elevatable body 230 being pivotally connected by a pin 231 to the lever 226 at the other end thereof. A stopper 232 is secured at the lower edge thereof to the elevatable body 230 at the upper end thereof, and is adapted to be movable between positions above and below the carriage of the roller conveyor 202. Rolls 233 are mounted at both sides of the upper end of the stopper 232 so as to allow the carton to pass therethrough even if succeeding cartons are delayed and the stopper 232 pushes the delayed, carton slightly up when it proceeds over the stopper 232.

Between the two lines of the roller conveyors 202 are a sprocket 234 inside one of the conveyors 202 at the rear end thereof, a sprocket 235 in front of said sprocket 234, a sprocket 236 inside the other conveyor 202 so as to position behind said sprocket 234 (at the position right below the front end of the feeding roller conveyor 203), and a sprocket 237 on the same side so as to position between the sprockets 234 and 235 at substantially the same intervals in the same level. Furthermore, sprockets 238 and 239 right below the sprockets 234 and 235, respectively, and sprockets 240 and 241 right below the sprockets 236 and 237, respectively, are provided. An endless chain 242 is entrained around the sprockets 236, 237, 240 and 241, and an endless chain 243 is entrained around the sprockets 234, 235, 238 and 239. A runner 244 is between the chains 242 and 243, the rear end of the runner 244 being connected to the chain 242, and the front end of the runner 244 being connected to the chain 243. An engaging plate 245 is mounted on the runner 244 so that the plate 245 directs upward at right angles to the forwarding runs of the said runner when it travels along chains 242 and 243; said engaging plate 245 is adapted to project above the roller conveyor 202 when it runs along the forwarding runs of the chains 242 and 243.

Sprockets 246 and 247 are secured to the shaft 142 so as to be positioned inside the side frames 201, and a chain 250 is entrained between the sprocket 240 and another sprocket 249 secured to a shaft 248 of the sprocket 241. Sprockets 252, 253 and 254 are secured to a shaft 255 of the sprocket 234, and a chain 258 and a chain 259 are entrained between the sprockets 247 and 253 and between the sprockets 252 and 256, respectively. A chain 262 is entrained between the sprocket 257 and a sprocket 261 secured to a shaft 260 which project from one side of the front end roller of the feeding roller conveyor 203, a chain 265 is entrained between the sprocket 257 and a sprocket 261 secured to a shaft 260 projecting from one side of the front end roller of the feeding roller conveyor 203; and a chain 265 is entrained between the sprocket 254 and a sprocket 264 secured to a shaft 263 projecting from one side of the rear end roller of the sending-out roller conveyor 204.

Figure 1:
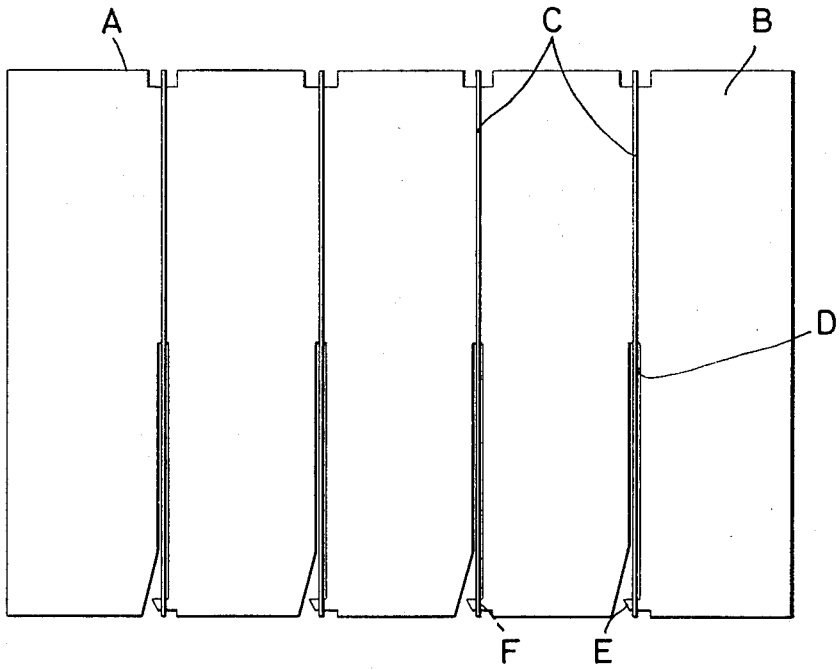
FIG. 1 is a front view of a partition lattice opened so that the longitudinal partition panels and transverse partition panels of the lattice cross at right angles.
Figure 2:
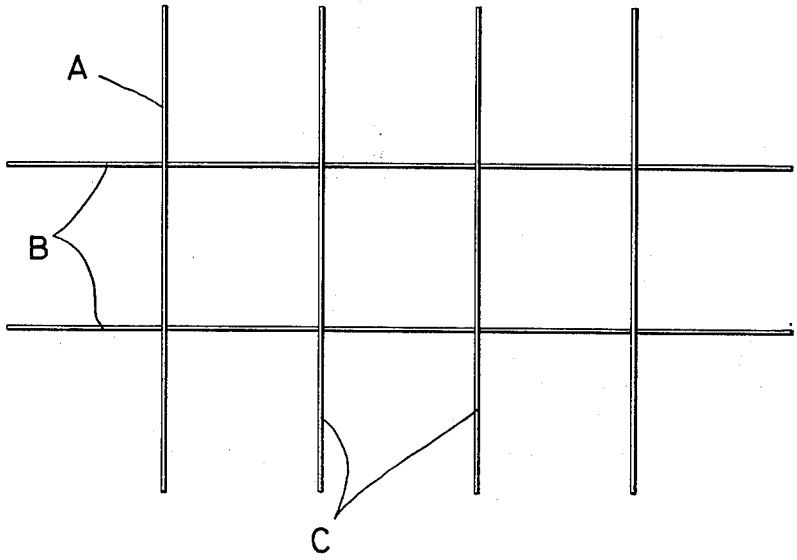
FIG. 2 is a plan view of the same.
Figure 3:
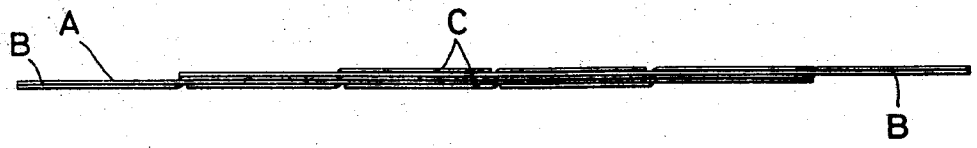
FIG. 3 is a plan view of a planely collapsed partition lattice.
Figure 4:
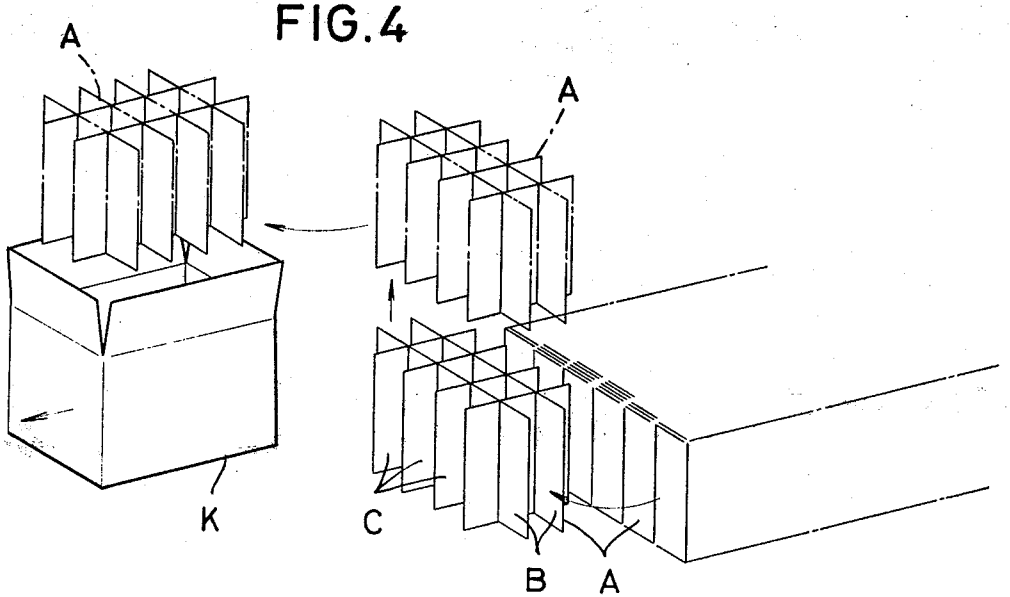
FIG. 4 is a perspective showing a succeeding process for inserting a partition lattice.
Figure 5:
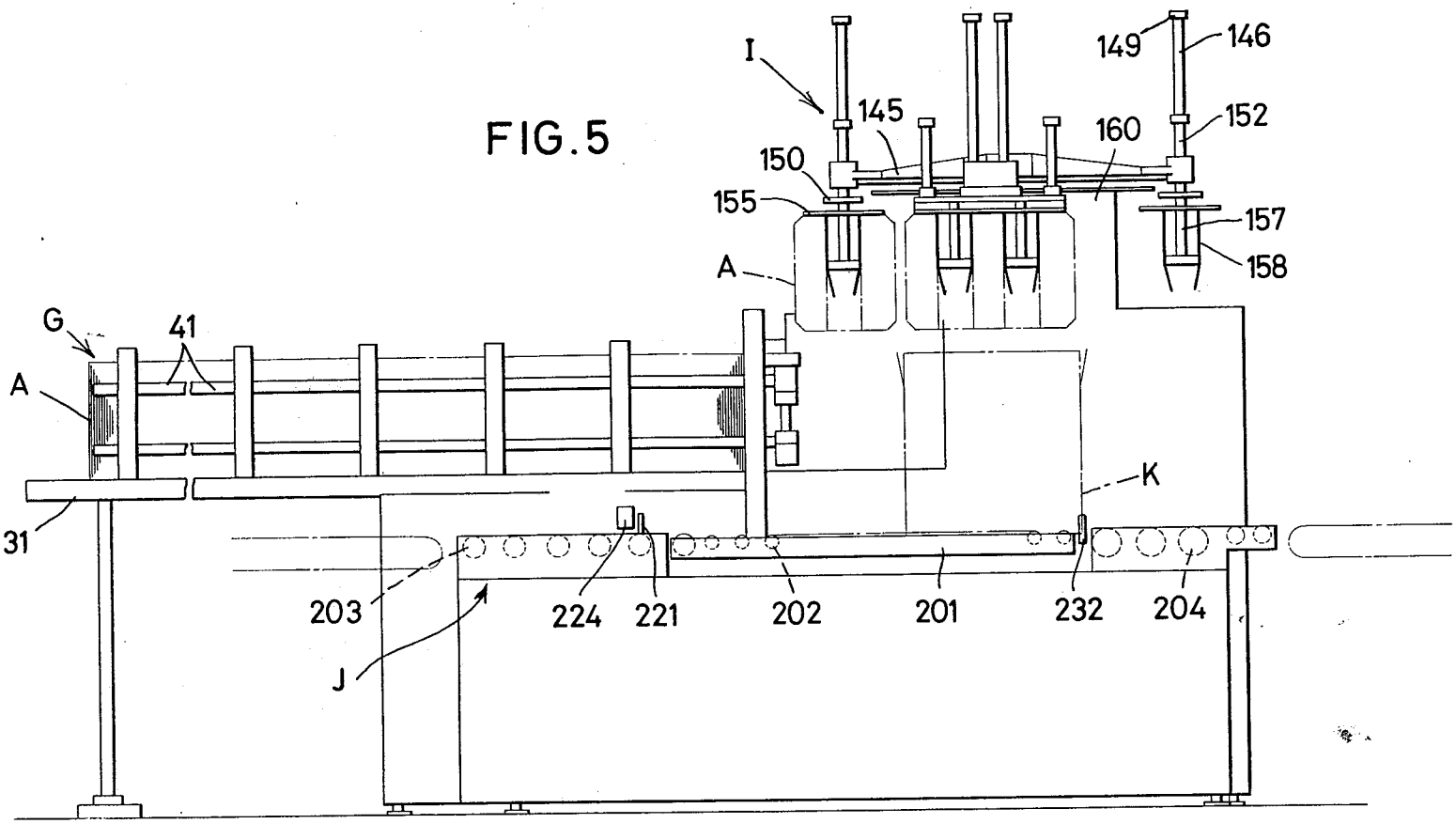
FIG. 5 is a side view of a partition lattice inserting apparatus.
Figure 6:
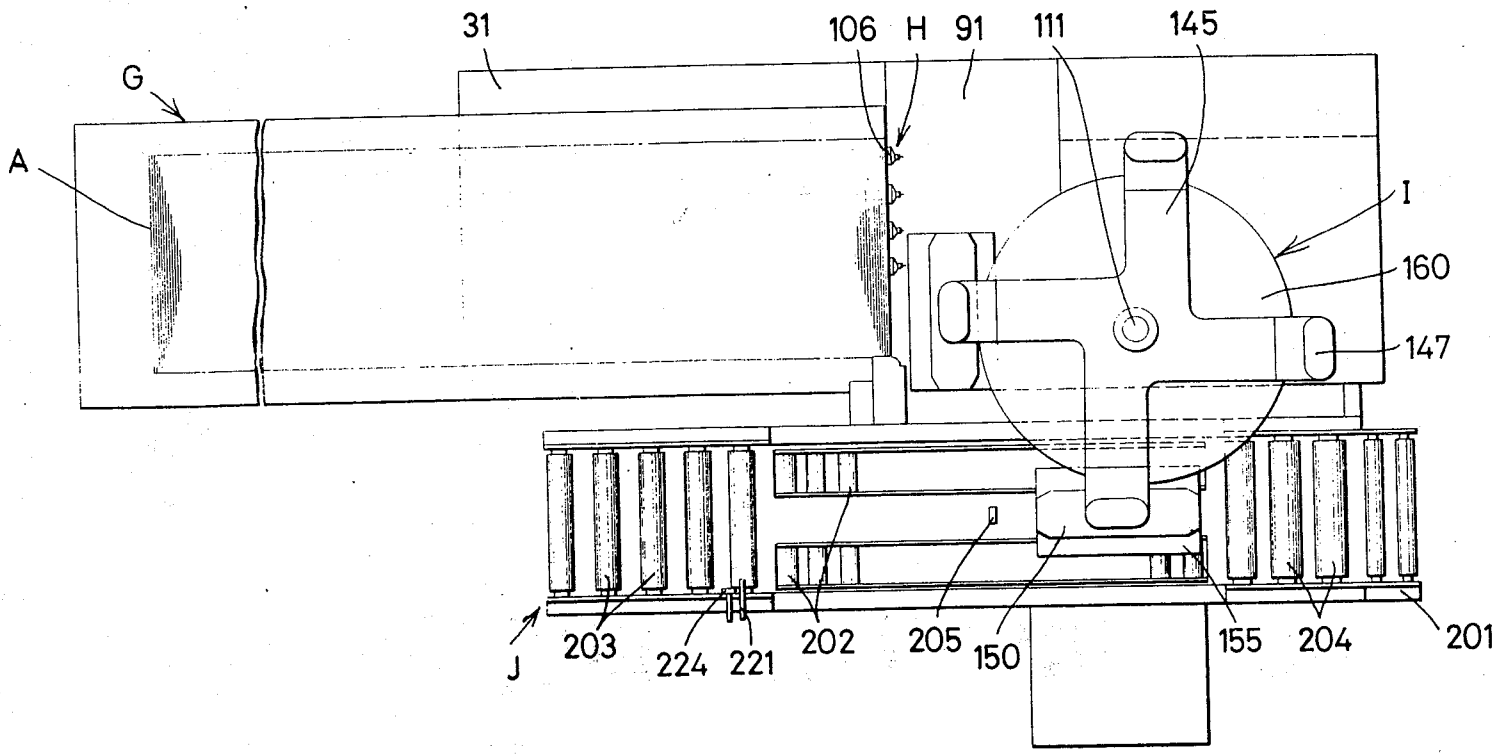
FIG. 6 is a plan view of the same.

The partition lattice inserting apparatus according to the present invention is constructed as hereinbefore described, and the operation thereof will now be explained. For the preparatory operation the partition lattice A constructed by the longitudinal and transverse partition panels B and C as shown in FIG. 2 are folded planely so that the panels B and C overlap one on the other as shown in FIG. 3.

A number of folded lattices A are supplied manually onto the table 31 from the rear to the front thereof so as to overlap the succeeding lattice onto the preceding one. In this situation, the side edges of the lattices A contact the inside faces of the guide plates 41, while the pusher 36 on the plate 37 mounted on the chain 35 is positioned at the rear end of the chain 35 at the upward surface thereof and is forced against the rear face of the trailing lattice A.

Another pile of lattices A is ready for the next supply on the rear end portion of the table 31, said lattices A being supplied successively between the pusher 36 and the rear end of the preceding lattice so as to feed the lattices continuously when the pusher 36 returns to the rear end of the advancing upward surface of the chain 35.

The driving shaft 50 is then driven counterclockwise as shown in FIG. 9 to cause the link 52, which is pivotally connected by the pin 53 at the eccentric position on the disc 51 rotating in the same direction with the driving shaft 50, to move forward and backward. As a result, the rocking plate 49, which is pivotally connected to the link 52 through the pin 54, turns through predetermined angles clockwise and counterclockwise in FIG. 9 around the shaft 48 as a fulcrum. When the upper end of said rocking plate 49 turns clockwise in FIG. 9, the click 73 on the rotary plate 71 disengages from the teeth of the gear 47 to slide therearound, but when turned counterclockwise, the click engages with the gear 47 to cause it to turn counterclockwise as shown is FIG. 9 through a small angle. The sprocket 34 is then driven counterclockwise (FIG. a) by the chain entrained between the sprocket 61 and the sprocket 59 on the same shaft with the gear 47, whereby the lattices A are forwarded a little by the advancement of the pusher 36 on the chain 35 which is entrained between the sprockets 34 and is driven thereby. Said pusher 36 is lowered below the table 31 so as to travel on the returning run of the chain 35 after the pusher 36 reaches the front end of the advancing upward surface of the chain 35.

The chain 45, which is entrained between the sprocket 44 on the shaft 42, is travelled as the shaft 42 is driven through the bevel gear 65 thereof meshing with the bevel gear 63 on the same shaft with the sprocket 34. Both edges of the lattice A are then kicked forward by the projecting pieces 46 on the advancing upward surface of the chain 45 so that both edges of the lattice A contacting the guide plates 41 will not delay behind the central portion of the lattice A, since both edges of the lattices A are thick when folded.

Simultaneously with the feed of the lattices A, the bell crank lever 55 is turned in predetermined angles clockwise and counterclockwise in FIG. 9 around the shaft 56 as a fulcrum by the cam 57 rotating together with the disc 51, thereby causing the elevatable link 75 and the elevatable member 79 extending from the lever 55 to intermittently move up and down. Since the elevatable member 79 is biased upward by the spring 81, the elevatable member 79 is elevated by the resiliency of the spring 81, this causing the rocking piece 84 to project above the front edge of the table 31 when the elevatable link 75 is elevated. When the elevatable link 75 is lowered, the upper end of the rocking piece 84 is caused to sink below the upper face of the table 31 since the pin 80 on the elevatable member 79 contacts with the upper end of the slot 77 in the elevatable link 75 causing the elevatable member 79 to ascend together against the resiliency of the spring 81.

In the case where there is no lattice on the table 31 at the front edge thereof, as the elevatable member 79 returns to its elevated position, the rotary plate 71 connected with the elevatable member 79 through the rod 87 is turned slightly clockwise (FIG. 9) around the pin 72 as a fulcrum causing the click 73 to engage with the gear 47 thereby rotating the gear 47 causing the pusher 36 to advance so as to feed the lattices A. It is needless to say that the eccentricity of the pin 53 on the disc 51 in relation to the position of the recess of the cam 57 is arranged so as to make the elevation of the elevatable member 75 coincide with the counterclockwise rotation of the rocking plate 49.

In the case where the lattices A have been fed on the front edge of the table 31, and since the restoration of the elevatable member 79 to its elevated position is prevented by the contact of the rocking piece 84 with the lower edge of the lattices A on the table 31, the click 73 is free from the gear 47 while the rocking plate 49 rocks counterclockwise and the rotary plate 71 is not caused to rotate clockwise (FIG. 9), whereby the pusher 36 will not advance due to the stoppage of the gear 47. As mentioned before, the lattices A are fed continuously towards the front edge of the table 31.

The transverse partition panels C of the leading lattice A are then contacted with the suction discs 106. After the suction by the suction hoses, when the shaft 93 together with the projecting piece 95 is rotated 90° clockwise (FIG. 12) by the retreatment of the movable plate 96, the plate member 99 is moved away from the front face of the leading lattice A by the action of the turning plate 98 turning in the same direction with the shaft 93. At this time, since the turnable plate 102 which is pivotally connected to one end of the plate member 99 is turned around the shaft 103 as a fulcrum, the plate member 99 moves away from the front face of the leading lattice A while maintaining its parallel relation with the lattice A. Since the plate member 109 rotates around the shaft 92 as a fulcrum 90° in the same direction with the shaft 93, each arm 104 connected to the plate member 99 turns 90° around the pin 105 as a fulcrum, thereby forcing the transverse partition panels C to rotate 90° in respect to the longitudinal partition panels B around the slits D as fulcrums, and thereby causing the folded lattice A to open so that the longitudinal and transverse partition panels B and C cross at right angles in a lattice-like shape.

After the folded lattice A is opened, the suction in the suction discs 106 is released, but the opening device H is adapted not to return to its original position before the opened lattice A is turned 90° to be transferred to the side of the delivery device J by the transfer device I. The opening device H is then returned to its position as follows: when the shaft 93 is rotated 90° counterclockwise (FIG. 12) by the advancement of the movable plate 96, the rotary plate 98 and the plates 102 and 109 are turned together in the same direction; during the rotation of these plates each arm 104 rotates 90° and the plate member 99 approaches the front face of the leading lattice A causing the suction discs 106 to contact one end of the tranverse partition panels C of the lattice C.

Said opened lattice A is transferred by the transfer device I which is in front of the opening device H and is turned 90° towards the delivery device J at the side of the transfer device I. This transfer is performed in the following manner. The rolls 181 and 180 on the elevatable plate 155 and the plate member 150 of the horizontal arm 145, which is stopped in the direction of the opening device H, ride on the rail 176 fitted in the notch 161 of the stationary disc 160. When the piston rod 169 is lowered by the action of the cylinder 166, the pinion 170 on the upper end of the piston rod 169 is also lowered while rotating counterclockwise in (FIG. 14), since the pinion 170 meshes with the fixed rack 173 in the post 162, and as a result, the elevatable body 164 having the rack 174 meshing with the pinion 170 is lowered under the guide of the rails 163 covering a distance twice as long as a motion of the piston rod 169, thereby lowering the plate member 150 and the elevatable plate 155 having the rolls 180 and 181 riding on the rail 176 while being guided by the shafts 146 slidably inserted in the bearings 147. The engaging body 158 positioned below the elevatable plate 155 is then inserted in a box surrounded by the longitudinal and transverse partition panels constructing the lattice A, and the panels C are held between the engaging body 158 and the clips 159. The cylinder 166 is then actuated reversely to the above-mentioned to cause the piston rod 169 to elevate; the elevatable body 164 is elevated to restore to its original position by the rotation of the pinion 170 in the reverse direction to the above-mentioned; and the lattice A is lifted while being held between the engaging body 158 and the clips 159 of the plate member 150 elevating together with the elevatable plate 155. The rail 176 is then fitted in the notch 161 so that the ends of the rail 176 correspond to the ends of the rail 177 provided on the lower face of the disc 160. In order to turn the lattice A, so lifted, 90° towards the delivery device J, since the gear 124 is rotated clockwise (FIG. 21) by the shaft 115 which is driven in one direction by the chain 120 entrained between the sprockets 118 and 119, the roll 132 of one of the arms 131 mounted on the gear 123 fits in the notch 130 in the lower rotary plate 129 causing the shaft 121 to turn counterclockwise through said lower rotary plate 129, whereby, after the rotation of the shaft 121 the movable gear 124 engages with the teeth of the tooth-broken gear 124 to turn the shaft 121; the roll 132 which was fitted in the notch 130 escapes out of the notch 130 during the rotation of the roll 130, the roll 126 of the upper rotary plate 125 turns together with the shaft 121 slipping in the inside end of the guide rail 114; and while the roll 126 is travelling along the guide rail 114, the circular table 113 is turned together with the shaft 111 counterclockwise. Before the lower rotary plate 119 rotates a completely around, the roll 132 of the other arm 131 fits into the other notch 130 (thereafter the movable gear 124 disengages from the teeth of the tooth-broken gear 123) causing the lower rotary plate 129 to turn. When the lower rotary plate 129 rotates completely, i.e., 360° the roll 132 disengages from the notch 131, and the roll 126, which was fitted in the guide rail 114 in order to rotate the circular table 113 together with the shaft 111 90°, is released from the guide rail 114 inward towards the shaft 101, and the circular table 113 and the shaft 111 are therefore turned intermittently 90° in one direction, thereby transferring the horizontal arm 145 for lifting the lattice from the position at the opening device H to the position at the delivery device J. Finally, during the transfer, the rolls 180 and 181 which rode on the rail 176 change to the rail 177 to travel thereon, and the following horizontal arm 145 positions right above the lattice A which was opened during the transfer operation of the preceding lattice A.

When the lattice A, lifted as above, is transferred to the position right above the delivery device, the roll 154 rides on the rail 195 which has been elevated to be ready for said riding. On the other hand, the rolls 180 and 181 are out of the rail 177 and fit in the notch 161 positioning right above the delivery device J.

The cylinder 187 is then actuated to lower the piston rod 188 together with the pinion 190. Since the pinion 190 rotates counterclockwise (FIG. 18) by the rack 192 fixed to the post 178, the elevatable member 185 having the rack 193 meshing with the pinion 190 is lowered along the rails 184 as a guide, thereby lowering the plate member 150 and the elevatable plate 155 through the roll 154 riding on the rail 195 at the end of the horizontal plate 194 while being guided by the bearing 147 in which are inserted the shafts 146. During the lowering, the stopper 183 on the connecting plate 149 connecting the upper ends of the shafts 146, 146 contacts the upper face of the bearing 147, but the connecting member 153 having the rolls 154 continues to descend. The elevatable plate 155 is, therefore, lowered together with the shafts 152 in spite of the stoppage of the plate member 150, thereby causing the upper edge of the lattice A to descend further and to release the transverse partition panel C from being held by the engaging body 158 and the clips 159. As a result, the engaging body 158 is pulled out of the box surrounded by the longitudinal and transverse partition panels B and C. The lattice A is thereby inserted into the carton K stopped at the front end of the conveying run of the roller conveyor 202 by the stopper 232 which maintains its elevated position.

After the insertion of the parition lattice A into the carton K, the elevatable member 185 is elevated together with the piston rod 188 by the action of the cylinder 187. During the elevation, the elevatable plate 155 alone is elevated at first, thence the upper face of the elevatable plate 155 contacting the lower face of the plate member 150 to bring up the latter. After the plate member 150 returns to its elevated position, since the shaft 111 rotates 90°, the rolls 180 and 181 ride on the rail 177 and the rolls 154 are out of the rail 195. The above operation is repeated, i.e. the opened lattice A is initially lifted and thereafter is transferred to the position 90° from the lifted position, thereby being lowered to be inserted into the carton K.

Figure 24:
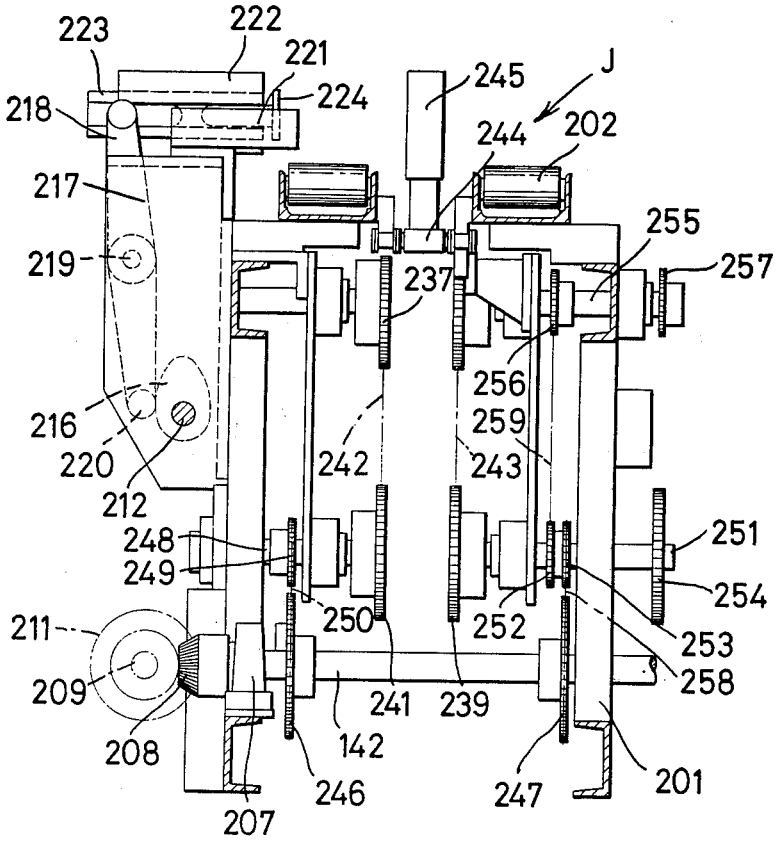
FIG. 24 is a section taken substantially along the line 24—24 in FIG. 22.

The carton K fed from the rear end facing the advancing direction of the delivery roller conveyor 203 reaches the front end thereof and comes to a stop under the effect of the stopper 221, said stopper 221 holding said carton K at the front side edge thereof. Then, the rocking plate 218 is turned clockwise (FIG. 24) around the pin 219 as a fulcrum by means of the cam 216 rotating, causing the slider 223 connected to the upper end of the rocking plate 218 to advance while being guided by the guide rail 222. As a result, the plate 224 at the end of the slider 223 pushes the front portion of the side face of the carton K to release it from the stopper 221, and the carton K is transferred to the roller conveyors 202 at the rear end facing the advancing direction.

Figure 25:
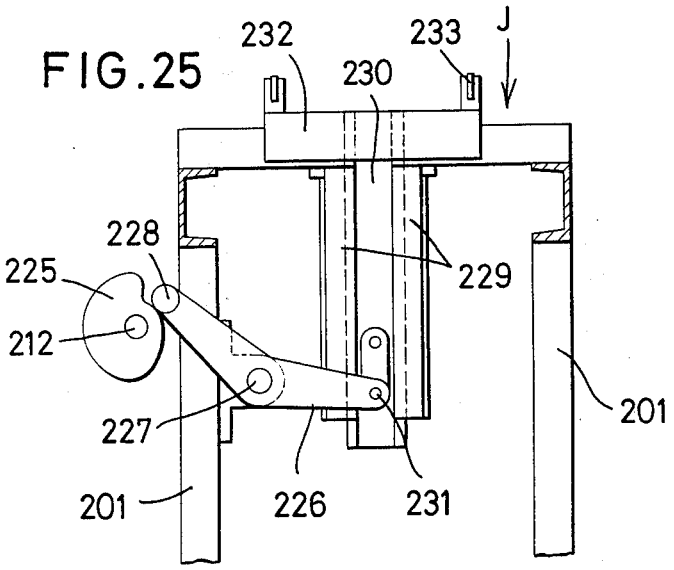
FIG. 25 is a section taken substantially along the line 25—25 in FIG. 23.

The carton K, which was transferred to the roller conveyors 202, travels towards the front ends of the roller conveyors 202 by the advancement of the runner 244 after the rear face of the carton K abuts the engaging plate 245 of the runner 244 which is returned to the rear end of the chains 242 and 243 entrained between the sprockets 234, 235, 236 and 237 and the sprockets 238, 239, 240 and 241, respectively. Before the carton K arrives at the front end of the roller conveyors 202, the lever 226, having the roll 228 abutting on the projecting edge of the cam 225, is turned counterclockwise (FIG. 25), thereby elevating the elevatable body 230 connected to the lever 226 while being guided by the guide rail 229 causing the stopper 232 at the upper end of the elevatable body 230 to project upward between the roller conveyors 202 and the send-out roller conveyor 204 for holding the carton K in which is inserted the lattice A.

After the insertion of the lattice A and the elevation of the engaging body 158, as the roll 228 abuts on the recessed edge of the cam 225, the elevatable body 230 is lowered, causing the stopper 232 to sink below the conveying runs of the roller conveyors 202 and 204, and the carton K having the lattice A inserted therein is transferred to the send-out conveyor 204 by being pushed by the following carton K supplied towards the front end of the conveying runs of the roller conveyors 202.

The engaging plate 245, which is adapted to push and convey the carton K towards the front end of the conveying run of the roller conveyor 204, disengages from the rear face of the carton K as the runner 244 travels from the rear end towards the front end of the chains 242 and 243, and the plate 245 returns to the rear ends of the chains 242 and 243 to convey the following carton K.

According to the present invention as described above, the partition lattices, which are constructed by inserting the slits provided in the longitudinal and transverse partition panels and which are folded planely, are fed one by one, and the leading lattice is opened so that the longitudinal and transverse partition panels cross at right angles, the opened lattice being then transferred and inserted in a hollow carton wholly automatically. Therefore, it has an excellent advantage of eliminating inefficient manual labour and the inconvenience of having to open the lattices manually, crossing the longitudinal partition panels at right angles to the transverse partition panels, and inserting the lattice into cartons while holding them by hand.

As for the opening device for the folded partition lattices, since the lattices are opened by sucking one end portions of the transverse partition panels so that the longitudinal and transverse partition panels cross at right angles, the lattices are opened into a regular tetragon, so there is no difficulty inserting them into hollow cartons.

What is claimed is:

1. An apparatus for inserting into a hollow carton a partition lattice which is assembled from longitudinal partition panels having slits at equal spaces extending upward from the lower edges thereof and transverse partition panels having slits at equal spaces extending downward from the upper edges thereof, whereby inserting said slits into one another forms a lattice-like shape, said apparatus comprising:

a support table;

feeder means toward the front of said table for feeding the folded partition lattices overlapping one on the other in a vertical arrangement on the table towards the front end of said table;

opening means for opening the folded partition lattice, said opening means comprising:

a plate member in front of the leading partition lattice, said plate member being parallel to the longitudinal partition panel at one side thereof and movable therefrom while maintaining the parallel relation in respect to the partition lattice;

pivoted arms, equal to the number of partition panels, pivoted on said plate member at an angle of 45° before the panel is moved with the same intervals therebetween as between said transverse partition panels;

suction discs provided on the ends of said arms sucking the end portions of said transverse partition panels; and a turnable plate adapted to cause said arms to turn synchronously 90° when said plate member moves away from said partition lattice;

lifting means at the front of said opening device for lifting the opened partition lattice as said lifting means elevates;

transfer means for transferring the lifted partition lattice to a position directly above a waiting hollow carton; and means for inserting the partition lattice into said carton and for releasing the partition lattice from being held by said transfer means.

2. An apparatus as claimed in claim 1, wherein said opening means is comprised of:

two parallel vertical shafts at the front of and adjacent to the side of said leading partition lattice, the second shaft being nearer the lattice and the first shaft being farther from the lattice than the second shaft and rotatable through an angle of 90°;

a plurality of first L-shaped turning plates horizontally fixed parallel to each other and fixed at one end thereof to the first shaft for movement with the first shaft and parallel to the leading partition lattice;

rotary plate members pivotally attached to the end of each turning plate parallel to the leading partition lattice and projecting beyond the edge of said table;

a vertical linking rod connecting the free ends of said rotary plate members to each other;

a revolving plate rotatably connected at one end thereof to the lower end of said vertical linking rod;

a third rotatable shaft underneath and substantially at the middle of the leading partition lattice, the distance between the first shaft and the rotatable third shaft being equal to the length of the rotary plate members;

a plurality of equally spaced arms equal to the number of transverse partition panels in the partition lattice pivoted in the middle thereof at an angle of 45° to the rotary plate members before the leading lattice is removed from the rest of the lattices;

a plurality of suction discs, one at the end of each equally spaced arm opposing said partition lattice with the suction portion directed toward the lattice;

a connecting rod attached to the plurality of equally spaced arms at the end opposite the suction discs;

a plurality of second turning plate members corresponding to the number of first turning plate members rotatably supported at one end by said second shaft above each corresponding turning plate having a forked portion integrally formed at the other end and fixed at said forked projections to the equally spaced arms nearest the second shaft, whereby rotating the first shaft 90° causes the rotary plate members to move away from the front face of the leading lattice by the action of the first turning plates turning in the same direction with the first shaft; causes the revolving plate operatively connected to said rotary plate by said vertical linking rod connecting said rotary plate members which are pivotally attached to said first turning plates to revolve; causes the rotary plate members to move away from the face of the leading lattice while maintaining a parallel relation to the lattice; causes the second turning members connected to the spaced arms pivotally connected to the rotating plates to rotate about the second shaft in the same direction as the rotation of the first shaft, and causes each of the arms connected to the plate members to pivot 90° on the rotary plate member; thereby causing the folded partition lattice to open so that the longitudinal and transverse partition panels cross at right angles in a lattice-like shape.

* * * * *